US011275324B2

(12) United States Patent
Sasame et al.

(10) Patent No.: US 11,275,324 B2
(45) Date of Patent: Mar. 15, 2022

(54) IMAGE FORMING APPARATUS THAT CONTROLS TRANSFER CURRENT IN A CASE IN WHICH A SECOND TONER IMAGE IS TRANSFERRED TO A SAME RECORDING MATERIAL AS A FIRST TONER IMAGE

(71) Applicant: CANON KABUSHIKI KAISHA, Tokyo (JP)

(72) Inventors: Hiroki Sasame, Fuchu (JP); Tomoo Akizuki, Kawasaki (JP); Yusuke Shimizu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/011,822

(22) Filed: Sep. 3, 2020

(65) Prior Publication Data

US 2021/0072662 A1 Mar. 11, 2021

(30) Foreign Application Priority Data

Sep. 10, 2019 (JP) ..... JP2019-164955

(51) Int. Cl.
*G03G 15/00* (2006.01)
*G03G 15/08* (2006.01)
(Continued)

(52) U.S. Cl.
CPC ..... *G03G 15/0808* (2013.01); *G03G 15/0225* (2013.01); *G03G 15/087* (2013.01); *G03G 15/0907* (2013.01); *G03G 15/2003* (2013.01)

(58) Field of Classification Search
USPC ..... 399/55
See application file for complete search history.

(56) References Cited

U.S. PATENT DOCUMENTS 6,205,301 B1 * 3/2001 Shigeta ..... G03G 15/232 399/308
6,266,495 B1 * 7/2001 Yuminamochi .... G03G 15/1675 399/314
(Continued)

FOREIGN PATENT DOCUMENTS

JP 2000-284570 A 10/2000
JP 2004-177437 A 6/2004
(Continued)

*Primary Examiner* — Quana Grainger
(74) *Attorney, Agent, or Firm* — Canon U.S.A., Inc. I.P. Division

(57) ABSTRACT

In an image forming apparatus, in a case in which a second toner image to be transferred to a same recording material as a first toner image is to be transferred is formed on the photosensitive member after the first toner image is formed on the photosensitive member and the first toner image is formed on an area of the photosensitive member including at least a part of a position of the second toner image one cycle before with respect to a movement direction of the surface of the photosensitive member, a control unit changes a value of a transfer current at a time of transferring the first toner image to a transfer-receiving member between a first value and a second value of which an absolute value is greater than an absolute value of the first value, based on image information regarding the second toner image.

9 Claims, 13 Drawing Sheets

(51) Int. Cl.

| | |
|---|---|
| ***G03G 15/09*** | (2006.01) |
| ***G03G 15/02*** | (2006.01) |
| ***G03G 15/20*** | (2006.01) |

(56) References Cited

U.S. PATENT DOCUMENTS

| | | | | |
|---|---|---|---|---|
| 2006/0029410 | A1* | 2/2006 | Deguchi | G03G 15/1675 399/66 |
| 2009/0196639 | A1* | 8/2009 | Ozeki | G03G 15/081 399/55 |

FOREIGN PATENT DOCUMENTS

| | | | |
|---|---|---|---|
| JP | 5197264 | B2 | 5/2013 |
| JP | 5808314 | B2 | 11/2015 |
| JP | 5998954 | B2 | 9/2016 |

* cited by examiner

IMAGE FORMING APPARATUS THAT CONTROLS TRANSFER CURRENT IN A CASE IN WHICH A SECOND TONER IMAGE IS TRANSFERRED TO A SAME RECORDING MATERIAL AS A FIRST TONER IMAGE

BACKGROUND OF THE DISCLOSURE

Field of the Disclosure

The present disclosure relates to an image forming apparatus using an electrophotography system, such as a copy machine, a printer (an LED printer, a laser beam printer, etc.) and a facsimile apparatus.

Description of the Related Art

In an image forming apparatus using the electrophotography system, the surface of a photosensitive member for electrophotography is uniformly charged by a charging apparatus, the charged surface of the photosensitive member is exposed according to image information by an exposure apparatus, and an electrostatic latent image is formed on the photosensitive member. The photosensitive member for electrophotography is of a rotatable drum type or an endless-belt type, and is rotationally driven at a predetermined circumferential speed. Hereinafter, a case where the photosensitive member is a photosensitive drum is described as an example. The electrostatic latent image formed on the photosensitive drum is developed (visualized) with a toner supplied as a developer by a developing apparatus, and a toner image is formed on the photosensitive drum. The toner image formed on the photosensitive drum is transferred to a recording material by a transfer apparatus. Thereafter, the toner image is fixed (fused, fixated) to the recording material by a fixing apparatus, and the recording material is discharged (output) to the outside of an image forming apparatus. The transfer residual toner remaining on the photosensitive drum after the transfer process is removed by a cleaning apparatus.

Generally, since the length of a recording material in a conveyance direction is longer than the circumferential length of a photosensitive drum, an image to be transferred to one recording material is formed by being divided into a plurality of cycles of the photosensitive drum while the photosensitive drum is rotated for the plurality of times. At this time, the history of image formation in the previous cycle of the photosensitive drum may affect image formation in the next cycle of the photosensitive drum, and good image formation may not be able to be performed.

For example, in the surface of the photosensitive drum after image formation, the surface potential is made to be non-uniform according to a formed image pattern. When a charging process in the next cycle is performed in this state, depending on the image pattern in the previous cycle, the surface of the photosensitive drum cannot be uniformly charged, and a desired electrostatic latent image may not be able to be formed in an exposure process in the next cycle. There is a "ghost image" as one of such image defects that are generated since the image pattern in the previous cycle of the photosensitive drum affects the image formation in the next cycle of the photosensitive drum. A ghost image is, for example, an image defect in which an image pattern in the previous cycle appears in a halftone image, when the halftone image is formed after forming a high-contrast image pattern.

In recent years, there is an image forming apparatus employing a "cleaner-less process", which does not include a special cleaning apparatus for cleaning the surface of a photosensitive drum after the transfer process, as described in Japanese Patent Application Laid-Open No. 2000-284570. In the image forming apparatus employing the cleaner-less process, the transfer residual toner remaining on the photosensitive drum after the transfer process is collected and reused in "simultaneous development cleaning" by a developing apparatus. The simultaneous development cleaning is a method of collecting the transfer residual toner remaining on the photosensitive drum after the transfer process by a recovery bias (the potential difference between the DC voltage applied to a development member provided in the developing apparatus and the surface potential of the photosensitive drum) at the time of development in or after the next process.

In the image forming apparatus employing the cleaner-less processes as described above, when performing simultaneous development cleaning of the transfer residual toner after the image formation in the previous cycle, a desired recovery bias may not be able to be obtained, depending on the image pattern formed by the image formation in the next cycle. In that case, the transfer residual toner remaining on the photosensitive drum after the image formation in the previous cycle may not be fully collected at the time of the development in the next cycle, and the toner may appear in the image pattern of this next cycle.

SUMMARY OF THE DISCLOSURE

An aspect of the present disclosure includes suppressing the generation of a ghost image due to image formation in the previous cycle of a rotatable photosensitive member affecting image formation in the next cycle of the photosensitive member.

The above object is achieved by an image forming apparatus according to an example of the present disclosure.

In summary, the image forming apparatus includes: a rotatable photosensitive member; a charging portion configured to charge a surface of the photosensitive member; an exposure portion configured to expose a charged surface of the photosensitive member based on image information to form an electrostatic image on the photosensitive member; a developing portion configured to supply a toner to the electrostatic image on the photosensitive member to form a toner image on the photosensitive member; a transfer portion configured to transfer the toner image on the photosensitive member to a transfer-receiving member at a transfer position; a power supply configured to supply a transfer current to the transfer portion; and a control unit configured to control the power supply, wherein the image forming apparatus is able to form an image on a recording material of which a length is longer than a circumferential length of the photosensitive member with respect to a conveyance direction of the recording material, and wherein, in a case in which a second toner image to be transferred to a same recording material as a first toner image is to be transferred is formed on the photosensitive member after the first toner image is formed on the photosensitive member and the first toner image is formed on an area of the photosensitive member including at least a part of a position of the second toner image one cycle before with respect to a movement direction of the surface of the photosensitive member, the control unit changes a value of the transfer current at the time of transferring the first toner image to the transfer-receiving member between a first value and a second value of which an absolute value is greater than an absolute value of the first value, based on the image information regarding the second toner image.

Further features and aspects of the present disclosure will become apparent from the following description of exemplary embodiments with reference to the attached drawings.

DESCRIPTION OF THE EMBODIMENTS

Hereinafter, an image forming apparatus according to the present disclosure is described in more detail in line with the drawings.

Example 1

1. General Configuration and Operation of an Image Forming Apparatus

Figure 1:
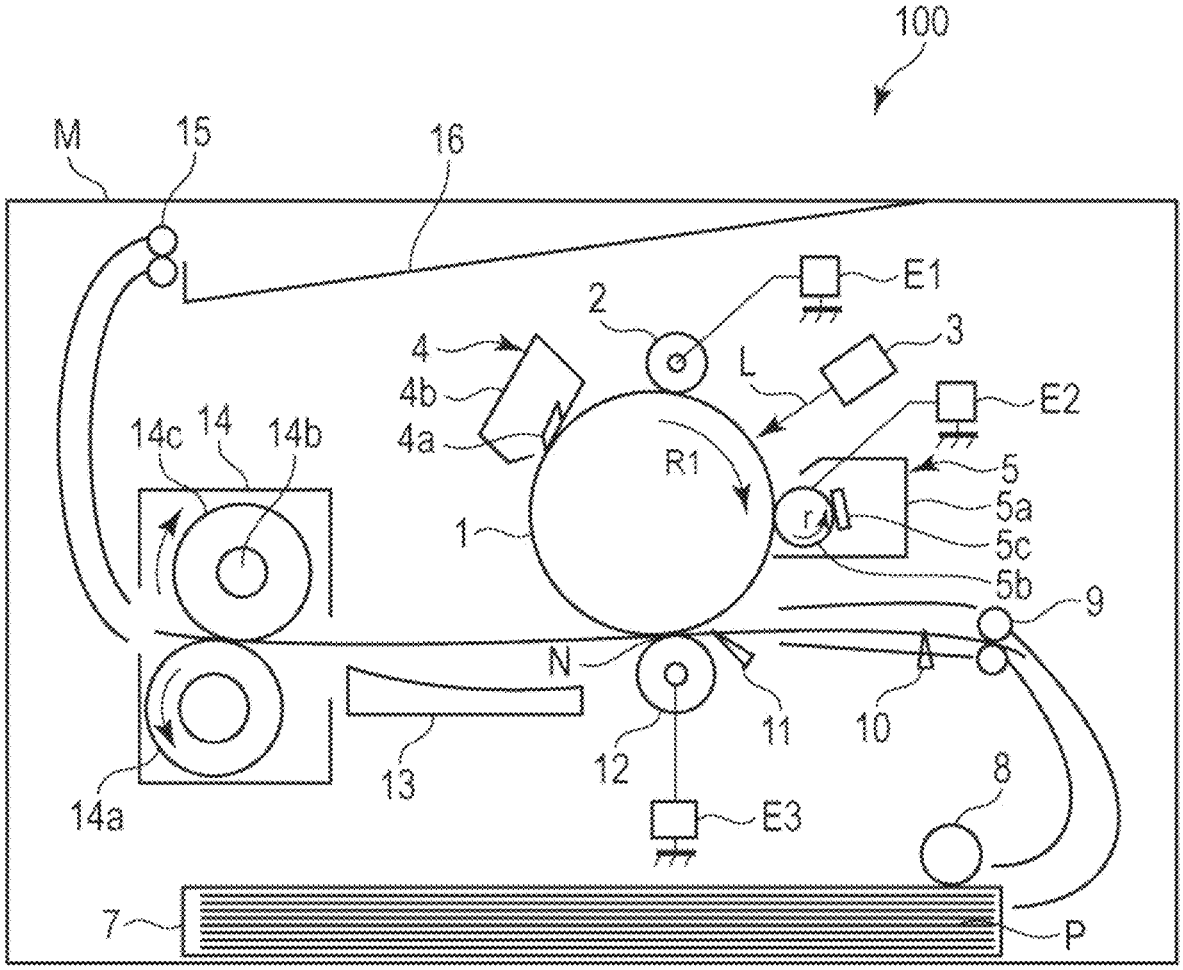
FIG. 1 is a schematic cross-sectional view of an image forming apparatus of an embodiment.

FIG. 1 is a schematic cross-sectional view of an image forming apparatus 100 of the present example. The image forming apparatus 100 of the present example is a monochrome laser beam printer using the electrophotography system.

A photosensitive drum 1, which is a rotatable photosensitive member (electrophotography photosensitive member), is rotationally driven in an arrow R1 direction (the clockwise rotation) in the figure by a driving motor (not illustrated) as a driving source. In the present example, the photosensitive drum 1 is rotationally driven at the circumferential speed (process speed) of 200 mm/sec. The surface of the rotating photosensitive drum 1 is uniformly charged to a predetermined potential of a predetermined polarity (the negative polarity in the present example) by a charging roller 2, which is a roller-shaped charging member as a charging unit (charging portion). At the time of a charging process, a predetermined charging voltage (charging bias), which is a DC voltage of the negative polarity, is applied to the charging roller 2 from a charging power supply E1 as a charging voltage application unit. The surface of the charged photosensitive drum 1 is scanned and exposed with laser light L that is irradiated based on image information from an exposure apparatus (a laser optical system, a laser scanner) 3 as an exposure unit (exposure portion). Accordingly, at least a part of the electric charge of an exposed part is removed, and an electrostatic latent image (electrostatic image) is formed on the photosensitive drum 1.

The electrostatic latent image formed on the photosensitive drum 1 is developed (visualized) by a toner as a developer supplied by a developing apparatus 5 as a developing unit (developing portion), and a toner image is formed on the photosensitive drum 1. The developing apparatus 5 is configured by including a development container 5*a* for receiving a black color toner, which is a non-magnetic single-component developer as the developer, a developing roller 5*b* as a developing member (developer carrier), a developing blade 5*c* as a regulation member, etc. The developing roller 5*b* is rotationally driven in an arrow r direction (the counterclockwise rotation) in the figure by a driving motor (not illustrated) as a driving source. The toner in the development container 5*a* is supplied on the developing roller 5*b*, the layer thickness of the toner on the developing roller 5*b* is regulated by the developing blade 5*c* with the rotation of the developing roller 5*b*, and a triboelectric charge is given to the toner. A toner layer coated on the developing roller 5*b* is conveyed to an opposing portion (developing position) between the photosensitive drum 1 and the developing roller 5*b* with the rotation of the developing roller 5*b*. Additionally, at the time of a developing process, a predetermined development voltage (development bias), which is a DC voltage of the negative polarity, is applied to the developing roller 5*b* from a development power supply E2 as a development voltage application unit. Note that, in the present example, the developing roller 5*b* is made to abut the surface of the photosensitive drum 1 at the time of the developing process. Accordingly, the toner is moved and adheres to the electrostatic latent image on the photosensitive drum 1 from the developing roller 5*b*. In the present example, the toner charged in the same polarity (the negative polarity in the present example) as the charging polarity of the photosensitive drum 1 adheres to the exposed part (image portion) on the photosensitive drum 1 in which the absolute value of the potential is decreased by being exposed after being uniformly charged (reversal development). In the present example, the normal charging polarity of the toner, which is the charging polarity of the toner at the time of development, is the negative polarity.

A transfer roller 12, which is a roller-shaped transfer member as a transfer unit (transfer portion), is arranged opposite to the photosensitive drum 1. The transfer roller 12 is pressed toward the photosensitive drum 1, and forms a transfer NIP (transfer position) N, which is a contact portion between the photosensitive drum 1 and the transfer roller 12. A recording material P, such as a recording paper, is housed in a recording-material cassette 7, supplied from the recording-material cassette 7 one sheet at a time by a feeding roller 8, conveyed by a pair of conveyance rollers 9, and conveyed to the transfer NIP N while being guided by a pre-transfer guide 11. At this time, the top end of the recording material P is detected by a top sensor 10, and is timed with the toner image on the photosensitive drum 1 and conveyed to the transfer NIP N. The toner image formed on the photosensitive drum 1 as described above is transferred onto the recording material P that is conveyed by being sandwiched between the photosensitive drum 1 and the transfer roller 12 by an action of the transfer roller 12 in the transfer NIP N. At the time of a transfer process, a transfer voltage (transfer bias), which is a DC voltage of the reversed polarity (the positive polarity in the present example) of the normal charging polarity of the toner, is applied to the transfer roller 12 from a transfer power supply E3 as a transfer voltage application unit. Accordingly, the toner image on the photosensitive drum 1 is transferred on a predetermined position of the recording material P by a transfer electric field formed between the photosensitive drum 1 and the transfer roller 12. In the present example, the voltage applied to the transfer roller 12 at the time of image formation (at the time of the transfer process) is controlled by constant current control that adjusts the output voltage value of the transfer power supply E3, so that the current value (transfer current value) flowing to the transfer roller 12 becomes constant. Additionally, in the present example, the transfer current value at the time of image formation is set to an optimum value according to the image information as will be described later in detail. Note that the magnitudes regarding current values are the magnitudes compared in absolute values, even when not explicitly specified. In the present example, since the surface of the photosensitive drum 1 is charged to the negative polarity, and the voltage of the positive polarity is applied to the transfer roller 12, a current flows from the transfer roller 12 to the photosensitive drum 1 in the transfer NIP N.

The recording material P on which the toner image has been transferred is conveyed along a conveyance guide 13 to a fixing apparatus 14 as a fixing unit. The fixing apparatus 14 includes a driving roller 14*a*, and a fixing roller 14*c* incorporating a heater 14*b*. The fixing apparatus 14 applies heat and pressure to the recording material P in the process of conveying the recording material P sandwiched between the driving roller 14*a* and the fixing roller 14*c*, so as to fix (fuse, fixate) the toner image to the recording material P. The recording material P after fixation of the toner image is discharged (output) onto a discharging tray 16 provided on an upper surface of an apparatus main body M of the image forming apparatus 100 by discharge rollers 15.

On the other hand, the transfer residual toner remaining on the photosensitive drum 1 after the transfer process is removed and collected from the photosensitive drum 1 by a cleaning apparatus 4 as a cleaning unit. The cleaning apparatus 4 scrapes off the transfer residual toner from the surface of the rotating photosensitive drum 1 by a cleaning blade 4*a* as a cleaning member arranged to abut against the surface of the photosensitive drum 1, and collects the transfer residual toner in a cleaning container 4*b*.

In the present example, the circumferential length of the photosensitive drum 1 is shorter than the length (297 mm) of the recording material P of, for example, A4 size (longitudinal feed) in the conveyance direction. Therefore, an image to be transferred to one recording material P of, for example, A4 size (longitudinal feed) is formed by being divided into a plurality of cycles of the photosensitive drum 1 while the photosensitive drum is rotated for the plurality of times. At this time, image formation can be performed one after another by repeating the above operation.

In the present example, the photosensitive drum 1, and the charging roller 2, the developing apparatus 5 and the cleaning apparatus 4 as a process unit to act on the photosensitive drum 1 are integrally formed into a cartridge as a process cartridge, which can be attached to and detached from the apparatus main body M. Additionally, in the present example, a recording-material cassette 7 housing the recording materials P, such as recording papers, is provided in a lower part of the apparatus main body M. Then, the feeding roller 8, the pair of conveyance rollers 9, the top sensor 10, the pre-transfer guide 11, the transfer roller 12, the conveyance guide 13, the fixing apparatus 14, the discharge rollers 15 and the discharging tray 16 are sequentially arranged along the conveyance path of the recording material P from the recording-material cassette 7.

Note that a special static elimination unit, such as a pre-charge exposure apparatus that performs static elimination of the surface of the photosensitive drum 1 after the transfer process and before the charging process, is not provided in the image forming apparatus 100 of this example.

2. Control Mode

Figure 2:
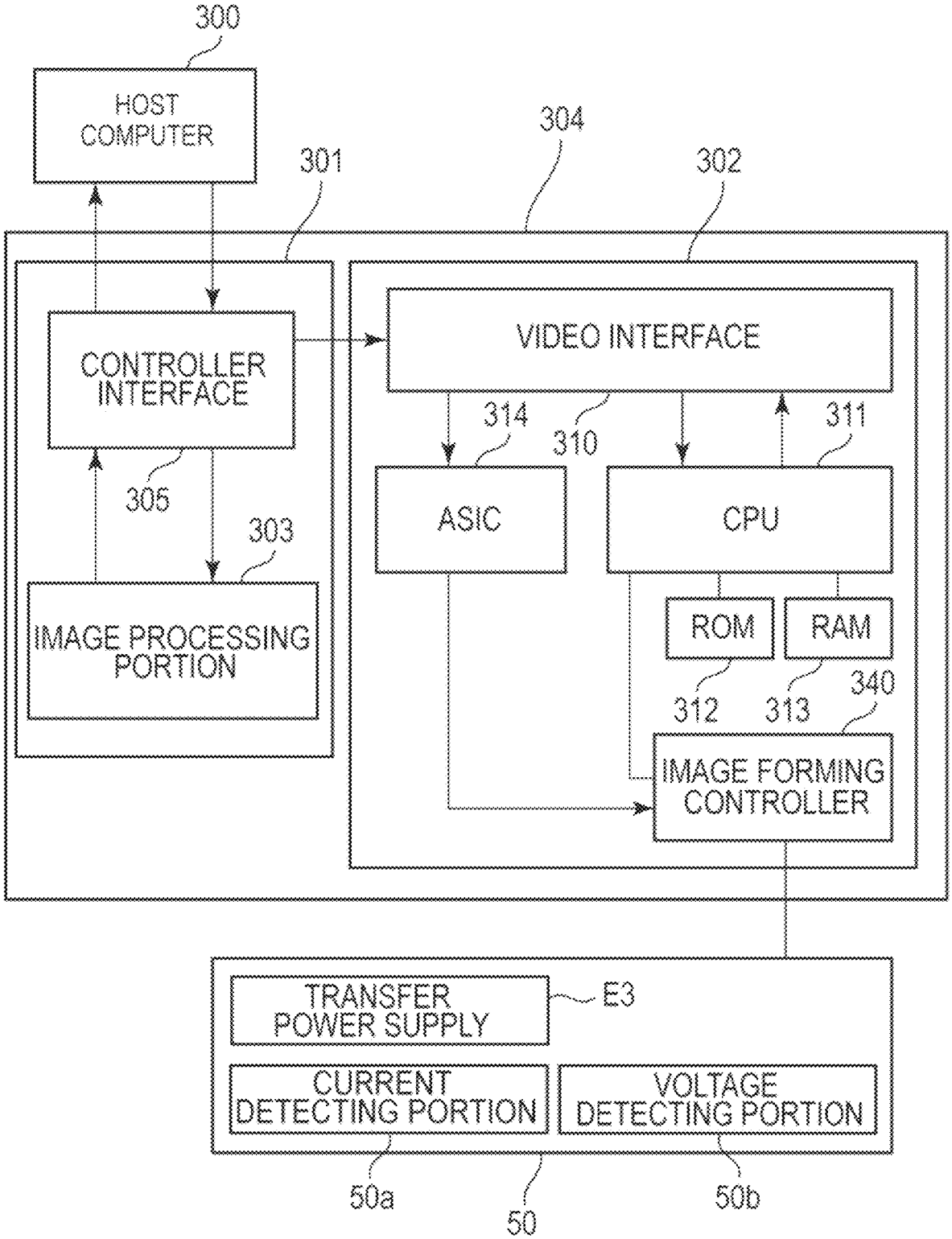
FIG. 2 is a schematic block diagram illustrating the control mode of an important part of the image forming apparatus.

FIG. 2 is a schematic block diagram illustrating the control mode (printer control system configuration) of an important part of the image forming apparatus 100 of this example. The image forming apparatus 100 includes a printer control apparatus 304 as a control unit (controller) that administers control of the entire image forming apparatus 100. The printer control apparatus 304 is broadly divided into a controller portion 301 and an engine controller 302. The controller portion 301 includes a controller interface 305 and an image processing portion 303. The engine controller 302 includes a video interface 310, a CPU 311, a ROM 312, a RAM 313, an ASIC 314 and an image forming controller 340.

The printer control apparatus 304 is connected to a host computer 300 external to the image forming apparatus 100 by using the controller interface 305, and performs communication with the host computers 300. The controller portion 301 performs bitmapping of character codes, halftoning processing of gray scale images, etc. in the image processing portion 303, based on image information (image data) received via the controller interface 305 from the host computer 300. Then, the image processing portion 303 transmits the image information (image data) to the video interface 310 of the engine controller 302 via the controller interface 305. The image information includes information for controlling the lighting timing of the exposure apparatus 3, information of the print mode for controlling process conditions, such as a control temperature and a transfer voltage, and information of the image size.

The information of the lighting timing of the exposure apparatus 3 is transmitted to the ASIC (Application Specific Integrated Circuit) 314 via the video interface 310. The ASIC 314 controls apart of the image forming unit controlled by the image forming controllers 340, such as the exposure apparatus 3. Note that the image forming unit is the general term for a mechanism portion that forms a toner image on the photosensitive drum 1 in the aforementioned process.

On the other hand, information regarding the setting of a print operation (image forming operation), such as the information of the print mode, and the information of the image size, are transmitted to the CPU (Central Processing Unit) 311 via the video interface 310. The CPU 311 stores information in the RAM 313, uses a program saved in the ROM 312 or the RAM 313, and refers to information saved in the ROM 312 or the RAM 313, as necessary. Then, based on these kinds of information, the CPU 311 controls the image forming controller 340 to control the process speed, the feeding of the recording material P, the developing process, the charging process, the transfer process, the fixing process, etc.

Additionally, the controller portion 301 receives a print instruction that is input by an operator, such as a user or a service person, from the host computer 300 etc. Then, according to the print instruction, the controller portion 301 transmits instruction information, such as a print command and a cancellation instruction, to the video interface 310 of the engine controller 302 via the controller interface 305. The instruction information is transmitted to the image forming controller 340 via the CPU 311, and the image forming controller 340 controls starting, stopping, etc. of the print operation.

3. Determination Method of Transfer Current Value

Next, the determination method of the transfer current value at the time of image formation in the present example is described. In the present example, the voltage applied to the transfer roller 12 at the time of image formation is controlled by constant current control. In the present example, a transfer power supply portion 50 is connected to the printer control apparatus 304 (more specifically, the image forming controller 340 of the engine controller 302). In the present example, the transfer power supply portion 50 includes the transfer power supply (power supply circuit) E3, a current detecting portion (current detecting circuit) 50*a* as a current detecting unit, and a voltage detecting portion (voltage detecting circuit) 50*b* as a voltage detecting unit. The current detecting portion 50*a* can detect the current value flowing to the transfer roller 12 (that is, the transfer NIP N or the transfer power supply E3), when the transfer power supply E3 is applying a voltage to the transfer roller 12. The voltage detecting portion 50*b* can detect the output voltage value of the transfer power supply E3 at the time when the transfer power supply E3 is applying the voltage to the transfer roller 12. The transfer power supply portion (transfer controller) 50 can adjust the output voltage value of the transfer power supply E3 so that the current value detected by the current detecting portion 50*a* becomes constant, so as to perform constant current control of the voltage applied to the transfer roller 12.

It is desired to determine an optimum value for the transfer current value at the time of image formation in terms of image quality. When the transfer current value is too low, a toner image is not sufficiently maintained on the recording material P, and so-called "scattering" may be generated in which the toner image collapses in the process of being conveyed to the downstream of the transfer NIP N with respect to the conveyance direction of the recording material P, and to the fixing apparatus 14. In addition, when the transfer current value is too high, a so-called "blank area" may be generated in which a part of an image becomes white by re-transferring. Re-transferring is a phenomenon in which the charging polarity of a toner on the recording material P is reversed and moves to the photosensitive drum 1, since the transfer current value is too high. In this manner, from a viewpoint of the image quality, it is desired to determine an optimum transfer current value in consideration of scattering and a blank area.

Note that the transfer current values at which scattering and a blank area are generated vary depending on, for example, a toner, the basis weight and electric resistance of a paper as the recording material P, an image pattern, and the environment (temperature, humidity, etc.) of the image forming apparatus 100 at the time of performing image formation. Therefore, an optimum transfer current value can be set according to these various conditions. Specifically, for example, optimum transfer current values are derived in advance from viewpoints of scattering and a blank area for each type of the recording material P, and for each environment of the image forming apparatus 100, and are stored in the ROM 312 as table data etc. Then, prior to image formation, the CPU 311 determines an optimum transfer current value according to the recording material P used for image formation, and the environment of the image forming apparatus 100 at the time of image formation, based on the information stored in the above-described ROM 312. Note that the type of the recording material P includes arbitrary information that can distinguish the recording material P, such as the attribute, for example, a regular paper, a cardboard, a glossy paper and a coated paper, the manufacturer, the brand name, the item number, the basis weight and the size. The CPU 311 can obtain the information of the type of the recording material P from the information on the setting of a print operation that is input from the host computer 300. In addition, the CPU 311 can obtain the information on the environment of the image forming apparatus 100, since a detection result (detection signal) of an environment sensor as an environment detection unit provided in the image forming apparatus 100 is input. However, in order to facilitate the understanding of the present disclosure, here, a description is given by assuming that the various conditions other than an image pattern, such as a toner, the type of the recording material P, and the environment of the image forming apparatus 100, are constant, and the transfer current value is not changed according to these.

4. Ghost Image

Next, a "ghost image" suppressed in this example is described. As described above, in the image forming apparatus 100 of the electrophotography system, in the surface of the photosensitive drum 1 after an exposure process, the developing process and the transfer process, the surface potential is made to be non-uniform according to a formed image pattern. When the charging process of the next cycle is performed in this state, depending on the image pattern of the previous cycle, the surface of the photosensitive drum 1 cannot be uniformly charged, a desired electrostatic latent image cannot be formed in the exposure process of the next cycle, and a ghost image may be generated.

Figure 3A:
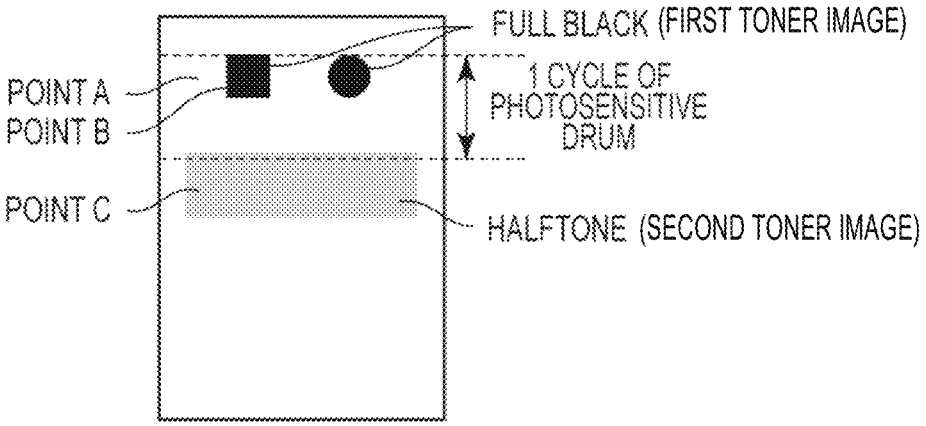
FIG. 3A is a schematic diagram of an example of an image pattern.
Figure 3B:
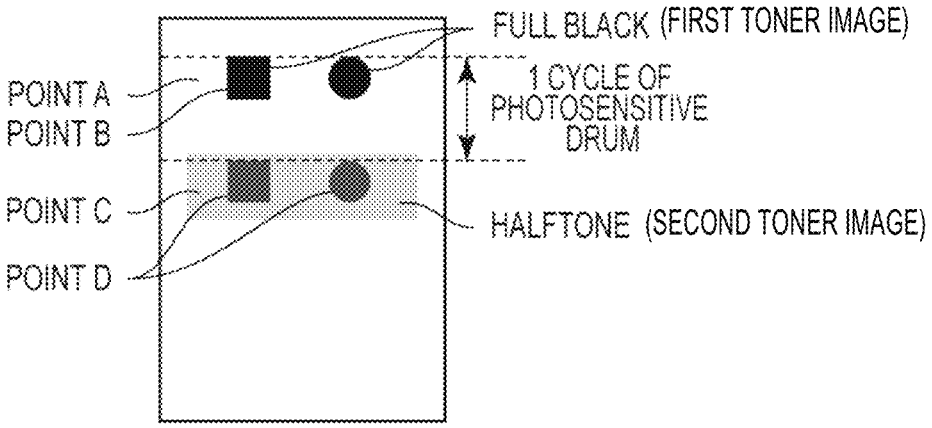
FIG. 3B is a schematic diagram of an example of an image pattern.
Figure 3C:
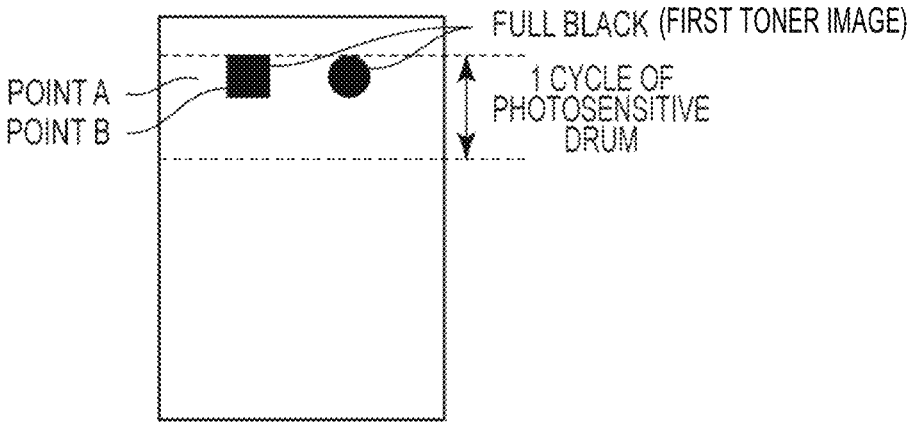
FIG. 3C is a schematic diagram of an example of an image pattern.

FIG. 3A, FIG. 3B and FIG. 3C are schematic diagrams for describing a ghost image. FIG. 3A illustrates image information that serves as the origin of image formation, and FIG. 3B illustrates an image formed according to the image information. FIG. 3C illustrates image information different from that in FIG. 3A (FIG. 3C will be described later). Note that it is assumed that the top end and the bottom end regarding an image mean the top end and the bottom end of the recording material P with respect to the conveyance direction, even when not explicitly specified.

In FIG. 3B, a point A is a full white portion (non-image portion), and a point B is a full black portion. Note that the full black portion is an image portion (so-called solid black portion) at the maximum concentration level. A halftone image is formed in the bottom end side of each of the point A and the point B. In addition, a point C and points D correspond to the positions of the point A and the point B after one cycle of the photosensitive drum 1, respectively. At this time, although a desired image is formed at the point C, ghost images have been generated at the point D, which are different from the image information in FIG. 3A.

In this manner, when the halftone image is formed after forming the high-contrast image pattern in which, for example, the full white portion and the full black portion are adjacent to each other, a ghost image may be generated in which the image pattern of the previous cycle appear in the halftone image. A ghost image is likely to be generated in an image (especially halftone image) formed in the exposure process of the cycle following the cycle in which a high-contrast image pattern has been formed on the photosensitive drum 1. Accordingly, in order to suppress the generation of a ghost image, it is important to make the potential difference between the exposed portion potential and the non-exposed portion potential of the surface of the photosensitive drum 1 formed in the exposure process of the previous cycle as small as possible by the charging process of the next cycle.

5. Relationship Between Transfer Current Value and Image Quality

In the present example, the surface of the photosensitive drum 1 is charged to the negative polarity by the charging roller 2, and the toner on the developing roller 5*b* is also charged to the negative polarity. In addition, at the time of image formation, the voltage of the positive polarity is applied to the transfer roller 12, and the current of the positive polarity flows to the photosensitive drum 1. Therefore, the surface potential of the photosensitive drum 1 is higher after passing through the transfer NIP N than before passing through the transfer NIP N (the absolute value of the surface potential of the negative polarity becomes small). At this time, the current value flowing to the surface of the photosensitive drum 1 from the transfer roller 12 is determined by the potential difference between the potential of the transfer roller 12 and the surface potential of the photosensitive drum 1, and the greater the potential difference, the higher the flowing current value. In addition, the higher the flowing current value, the higher the surface potential of the photosensitive drum 1 after passing through the transfer NIP N (the absolute value of the surface potential of the negative polarity becomes small).

In an image portion and a non-image portion on the photosensitive drum 1, since the potential difference from the transfer roller 12 is greater in the non-image portion, the flowing transfer current value is also higher in the non-image portion. Accordingly, the potential difference between the exposed portion potential and the non-exposed portion potential of the surface of the photosensitive drum 1 is smaller after passing through the transfer NIP N than before passing through the transfer NIP N.

Using FIG. 3B, the surface potential of the photosensitive drum 1 after passing through the transfer NIP N is described. When transferring the full black portion in FIG. 3B on the recording material P, the magnitude of the current that flows to the photosensitive drum 1 is different between the full black portion (point B) and the full white portion (point A). Since the current flowing to the full white portion is higher than the current flowing to the full black portion, the potential difference between the full black portion and the full white portion is smaller after passing through the transfer NIP N than before passing through the transfer NIP N. At this time, as a target transfer current value in the constant current control of the transfer voltage is increased, the ghost image in the halftone image is improved to be better. This is because the potential difference between the exposed portion potential and the non-exposed portion potential of the surface of the photosensitive drum 1 generated in the exposure process becomes small in the transfer NIP N.

In this manner, although the generation of a ghost image can be suppressed by increasing the transfer current value, it is desired to determine the transfer current value also by taking into consideration other image defects correlated with the transfer current value, such as scattering and a blank area. Especially, since a blank area is worsened when the transfer current value is increased, the blank area may be a trade-off for a ghost image.

6. Control of Transfer Current Value According to Image Information

Next, control of the transfer current value according to image information in this example is described. In the present example, the image forming apparatus 100 makes the surface potential of the photosensitive drum 1 to be uniform after the transfer process and before the charging process, and suppresses the generation of a ghost image, by adjusting transfer process conditions (more particularly, the transfer current value) based on image information.

As previously described, in the images in FIG. 3A and FIG. 3B, since the halftone image is in an area including the position after one cycle of the photosensitive drum 1 of the full black portion, a ghost image is likely to be generated. In such a case, it is desired to set the optimum transfer current value in consideration of each of scattering, a blank area, and a ghost image.

On the other hand, as in the image in FIG. 3C, when there is no halftone image in the area including the position after one cycle of the photosensitive drum 1 of the full black portion, it is desired to set the optimum transfer current value only in consideration of scattering and a blank area.

Therefore, in the present example, image information is obtained before performing the transfer process, and the transfer current value is set based on the image information.

Figure 13:
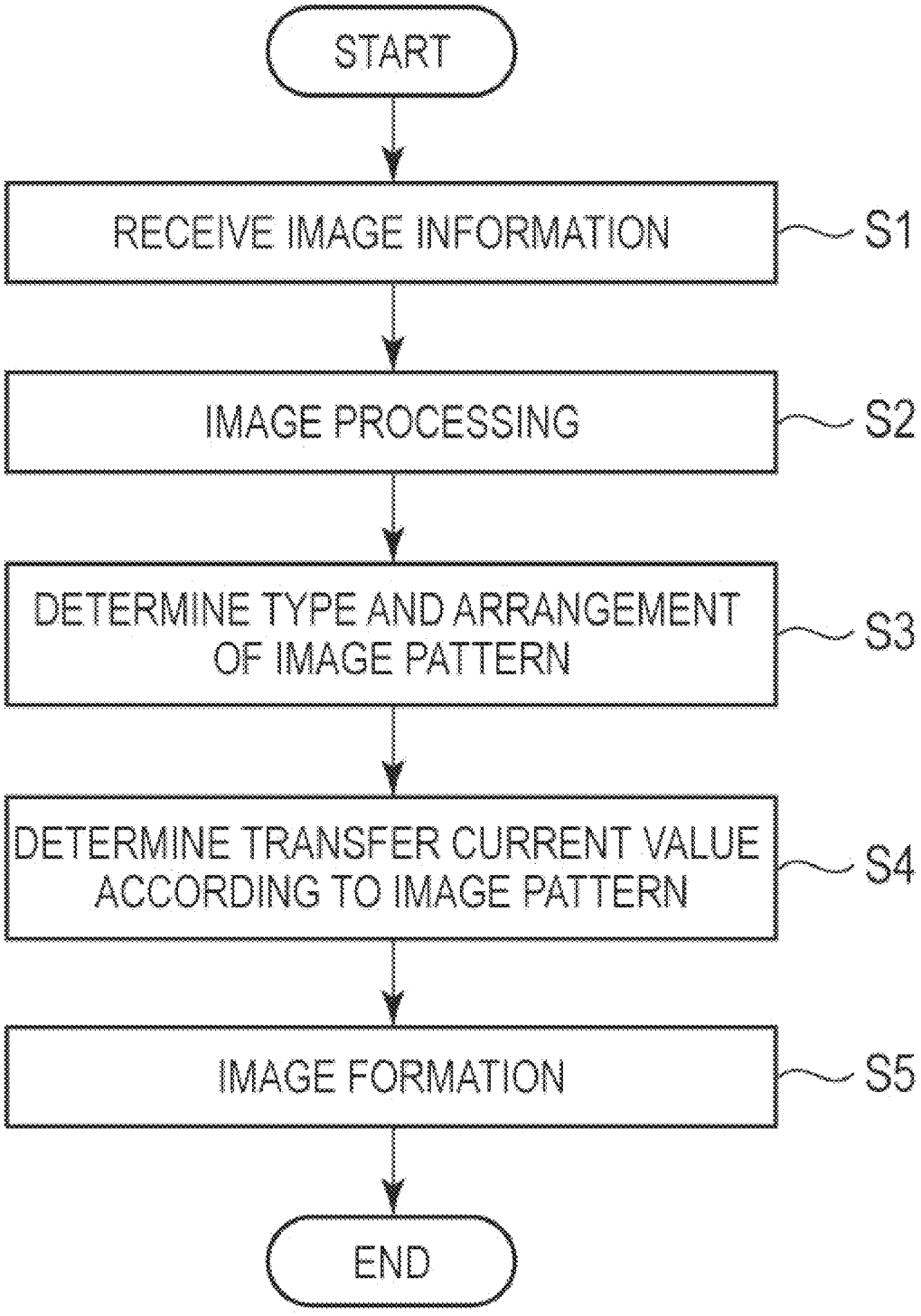
FIG. 13 is a flowchart illustrating the outline of the procedure for controlling the transfer-current value.

7. Analyzing Method of Image Information and Feedback Method to Control of Transfer Current Value Next, the analyzing method of image information and the feedback method to the control of the transfer current value in this example are described. FIG. 13 is a flowchart illustrating the outline of the procedure of control of the transfer voltage (the analysis of image information and the feedback to control of the transfer current value) in this example.

As previously described, the printer control apparatus 304 receives a print command, information regarding the setting of a print operation, and image information from the host computer 300 (S1). The image processing portion 303 of the printer control apparatus 304 performs halftoning processing of a gray scale image, etc. based on the image information received from the host computer 300 (S2). At this time, the image processing portion 303 analyzes the image information in parallel to, for example, the image processing, and performs the identification of the type of image patterns, such as a text image, a full black portion, and a halftone image, and the identification of the arrangement of each image pattern (S3). In addition, the CPU 311 of the printer control apparatus 304 performs processing for determining the optimum transfer current value according to the types of the image patterns and the arrangement of each image pattern, based on the analysis result of the image information in the image processing portion 303 (S4). Then, the printer control apparatus 304 causes the image forming apparatus 100 to perform image formation (S5). Note that the transfer current value may be determined before performing the transfer process for an image formed on each recording material P (before the top end of an image area reaches the transfer NIP N), and may be performed in parallel to the image formation.

Figure 4A:
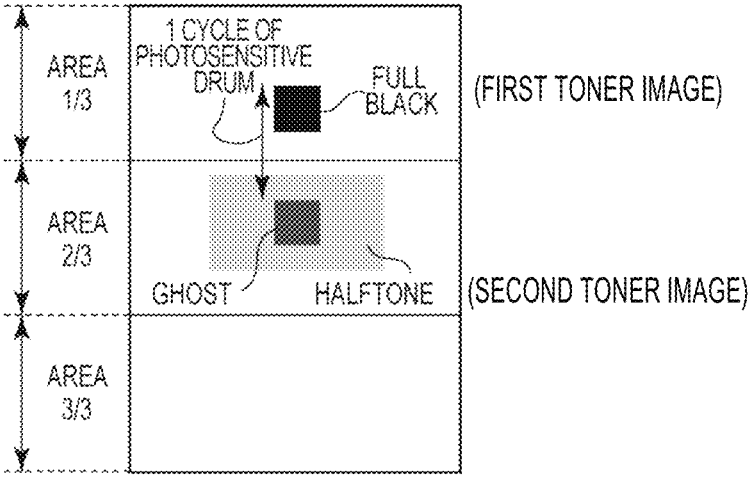
FIG. 4A is a schematic diagram for describing an example of an analyzing method of image information.
Figure 4B:
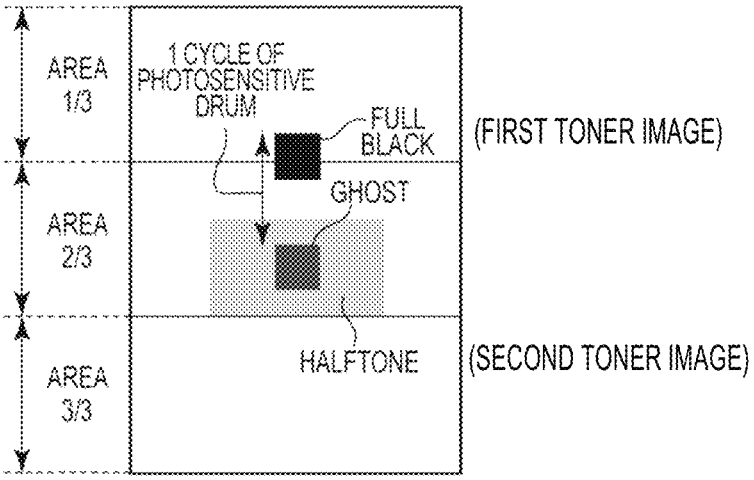
FIG. 4B is a schematic diagram for describing an example of the analyzing method of image information.
Figure 4C:
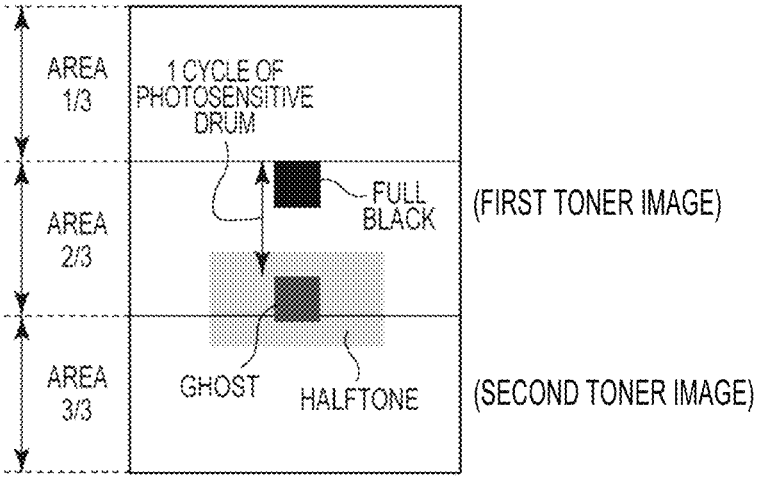
FIG. 4C is a schematic diagram for describing an example of the analyzing method of image information.

First, as illustrated in FIG. 4A, FIG. 4B and FIG. 4C, a case is described where, when forming an image on the recording material P of, for example, A4 size (longitudinal feed), the image information is analyzed by being divided into three, an area 1/3 to an area 3/3, in the conveyance direction of the recording material P. In this case, in the present example, the length of one area of the recording material P in the conveyance direction is longer than the circumferential length (one cycle) of the photosensitive drum 1.

As previously described, a ghost image is likely to be generated when a halftone image is formed after forming a high-contrast image pattern. Note that high-contrast image patterns here are, for example, in a case of a 600 dpi image, a line image (full black portion) having the width of 10 dot or more, a text image (full black portion), and an isolated pattern (full black portion) having an area equal to or more than a rectangle whose one side is 10 dot, etc. In addition, the halftone image here is an image having a coverage rate equal to or more than 5% and equal to or less than 80% in a case where it is assumed that, for example, the coverage rate (image ratio) of an area filed with the maximum concentration (100% concentration) of one pixel is 100%. Note that a high-contrast image patter is typically an image pattern in which a full white portion and a full black portion are adjacent to each other. However, this is not a limitation, and when a ghost image is generated in a case where, for example, a full black portion such as the above-described line image, text image, or pattern is in the above-described halftone image, such an image pattern may also be treated as a high-contrast image pattern.

As illustrated in FIG. 4A, FIG. 4B and FIG. 4C, in two adjacent areas, when a high-contrast image pattern is arranged in the area on the top end side, and a halftone image is in the area on the bottom end side, the transfer current value in at least the area on the top end side is changed. For example, in the image in FIG. 4A, a halftone image is in an area 2/3, and a full black portion is in the area 1/3 including the position of the halftone image one cycle of the photosensitive drum 1 before. In this case, the transfer current value of at least the area 1/3 is set to be higher than a normal transfer current value. Accordingly, the generation of a ghost image in the halftone image in the area 2/3 can be suppressed. Note that the normal transfer current value is an optimum transfer current value that is set in advance according to the type of the recording material P, the environment of the image forming apparatus 100, etc. in consideration of scattering and a blank area as previously described. At this time, the analyzing method of the image information and the feedback method to the control of the transfer current value include, for example, two kinds of methods as follows.

Method (1)

Whether or not there is a halftone image is determined in each area, and when there is the halftone image, the transfer current values of an area including the halftone image, and an area closer to the top end side are increased.

Method (2)

Whether or not there is a halftone image is determined in each area, and when there is the halftone image, and there is a high-contrast image pattern closer to the top end than the halftone image, the transfer current value of an area including the high-contrast image pattern is increased.

When control is performed for the image in FIG. 4A by each of the above-described Methods (1) and (2), it will be as follows.

In the case of Method (1)

Since the halftone image is in the area 2/3, the transfer current values of the area 1/3 and the area 2/3 are increased.

In the case of Method (2)

Since the halftone image is in the area 2/3, and a full black portion is in the area 1/3, the transfer current value of the area 1/3 is increased.

Here, the reason for also increasing the transfer current value of the area 2/3 in Method (1) is to take into consideration the possibility that the full black portion is in both the area 1/3 and the area 2/3 as in the image in FIG. 4B. When performing control for the image in FIG. 4B by Method (1), the transfer voltage values of the area 1/3 and the area 2/3 will be increased. Note that also when performing control for the image in FIG. 4B by Method (2), the transfer voltage values of the area 1/3 and the area 2/3 will be increased.

Method (1) has the advantage that the amount of data to be analyzed for image information is small. On the other hand, in Method (2), although the amount of data to be analyzed for image information is greater than in Method (1), the generation of a ghost image can be suppressed even if the areas in which the transfer current value is increased is less than in Method (1).

For example, in the image in FIG. 4C, a halftone image is in the area 2/3 and the area 3/3, and a full black portion is in the area 2/3. When control is performed for the image in FIG. 4C by each of the above-described Methods (1) and (2), it will be as follows.

In the Case of Method (1)

Since the halftone image is in the area 2/3 and the area 3/3, the transfer current values of the area 1/3, the area 2/3 and the area 3/3 are increased.

In the Case of Method (2)

Since the halftone image is in the area 2/3 and the area 3/3, and the full black portion is in the area 2/3, the transfer current value of the area 2/3 is increased.

Here, in the image in FIG. 4C, since the full black portion is in the area 2/3, in order to suppress the generation of a ghost image, the transfer current value of the area 2/3 may be increased. However, when determination is made with the image information of only the halftone image as in Method (1), considering the possibility that a high-contrast image is in the area 1/3, it is necessary to increase the transfer current value of the area 1/3, in addition to the area 2/3 and the area 3/3.

In this manner, in Method (1), there are more areas in which the transfer current value is increased than in Method (2). As previously described, since a blank area is worsened when the transfer current value is increased, the area where the transfer current value is increased can be minimized as much as possible.

Figure 5A:
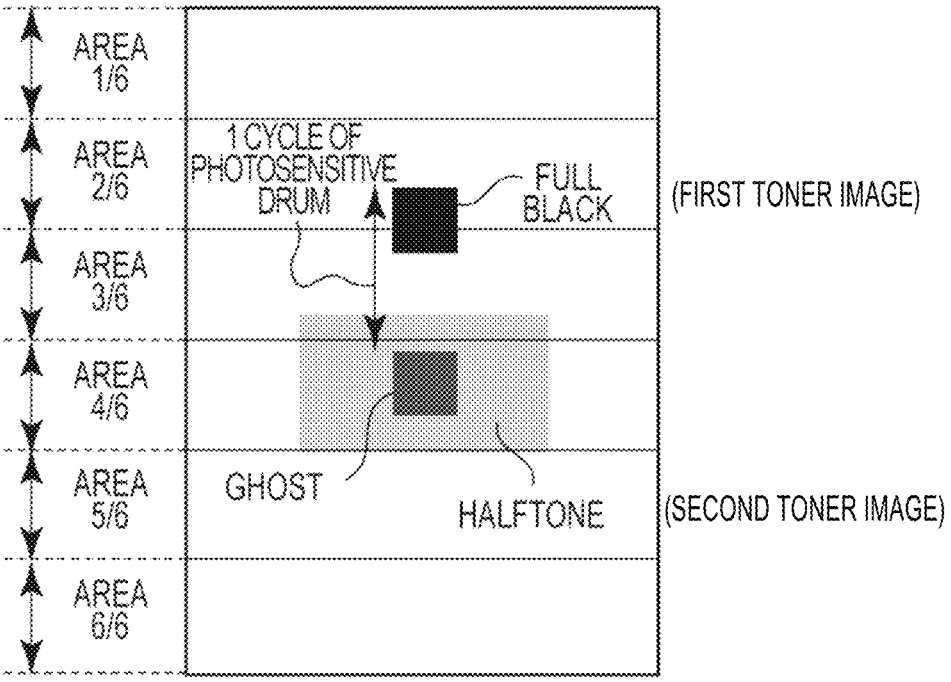
FIG. 5A is a schematic diagram for describing another example of the analyzing method of image information.
Figure 5B:
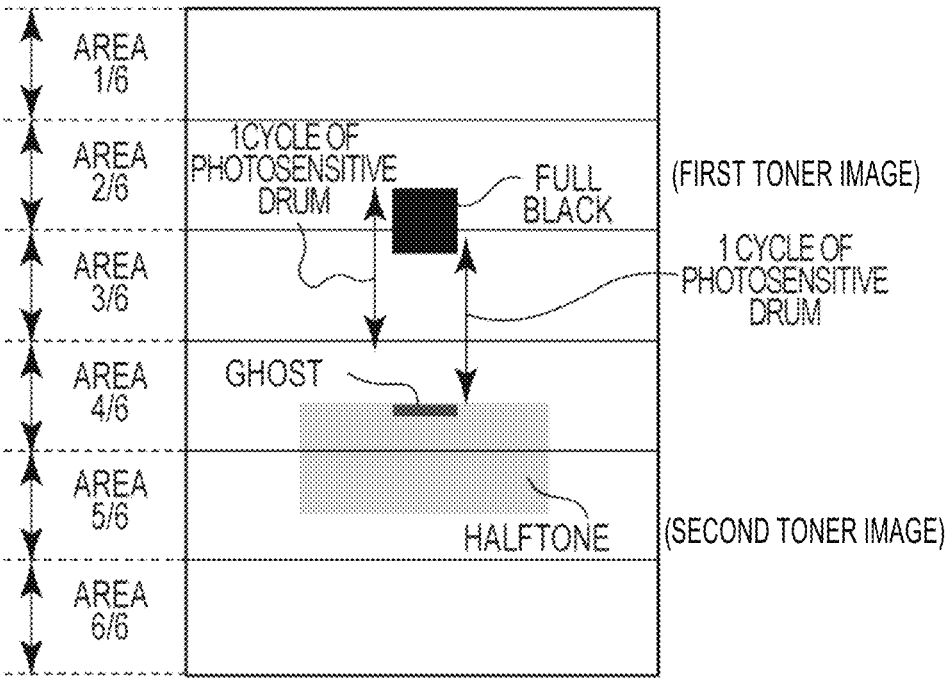
FIG. 5B is a schematic diagram for describing another example of the analyzing method of image information.

Next, the analyzing method of image information and the feedback method to the control of the transfer current value in a case where the number of divisions of the image information is increased more than in the above-described example and are described. Here, as illustrated in FIG. 5A and FIG. 5B, a case is described where, when forming an image on the recording material P of, for example, A4 size (longitudinal feed), the image information is analyzed by being divided into six, an area 1/6 to an area 6/6, in the conveyance direction of the recording material P. In this case, in the present example, the length of one area of the recording material P in the conveyance direction is shorter than the circumferential length (one cycle) of the photosensitive drum 1. For example, in FIG. 5A, the same image as in FIG. 4B is analyzed by being divided into six. When control is performed for the image in FIG. 5A by each of the previously-described Methods (1) and (2), it will be as follows.

In the Case of Method (1)

Since a halftone image is in the area 3/6 and the area 4/6, the transfer current values of the area 2/6, the area 3/6 and the area 4/6 are increased.

In the case of Method (2)

Since a halftone image is in the area 3/6 and the area 4/6, and a full black portion is in the area 2/6 and the area 3/6, the transfer current values of the area 2/6 and the area 3/6 are increased.

Here, comparing the case of three divisions as illustrated in FIG. 4B with the case of six divisions as illustrated in FIG. 5A, the area where the transfer current value is increased may be smaller in the case of six divisions as illustrated in FIG. 5A.

In this manner, by increasing the number of divisions of the image information to be analyzed, the area where the transfer current value is increased to suppress the generation of a ghost image can be made small.

Next, the analyzing method of image information and the feedback method to the control of the transfer current value in the case where the cycle (circumferential length) of the photosensitive drum 1 is taken into consideration are described. For example, in FIG. 5B, the image information obtained by shifting the halftone image of the image information in FIG. 5A to the bottom end side is divided into six and analyzed. In this case, in the aforementioned Method (2), the transfer current values of the area 2/6 and the area 3/6 will be increased. However, a ghost image is mainly generated due to the influence of the image pattern in one cycle of the photosensitive drum 1 before. Therefore, in the case of the image in FIG. 5B, of the area 2/6 and the area 3/6 including the full black portion, only the transfer current value of the area 3/6 including the position of the halftone image in one cycle of the photosensitive drum 1 before may be increased. In this manner, taking in consideration of the cycle (circumferential length) of the photosensitive drum 1, in addition to the analysis result of the image information, the area where the transfer current value is increased can be made as small as possible.

Note that the image information may also be divided in the conveyance direction of the recording material P for each cycle (circumferential length) of the photosensitive drum 1.

Figure 6A:
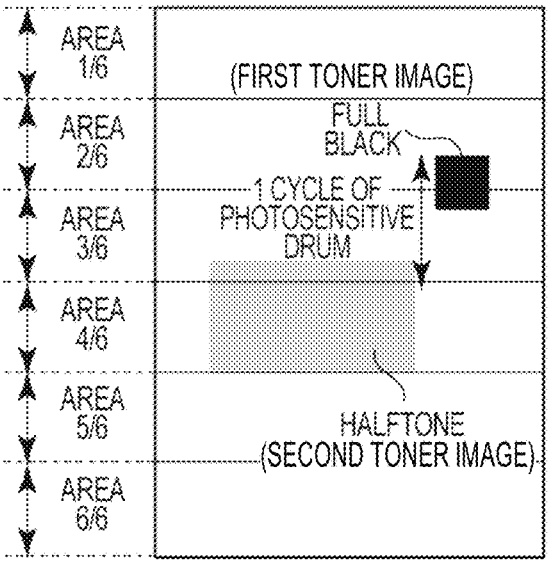
FIG. 6A is a schematic diagram for describing another example of the analyzing method of image information.
Figure 6B:
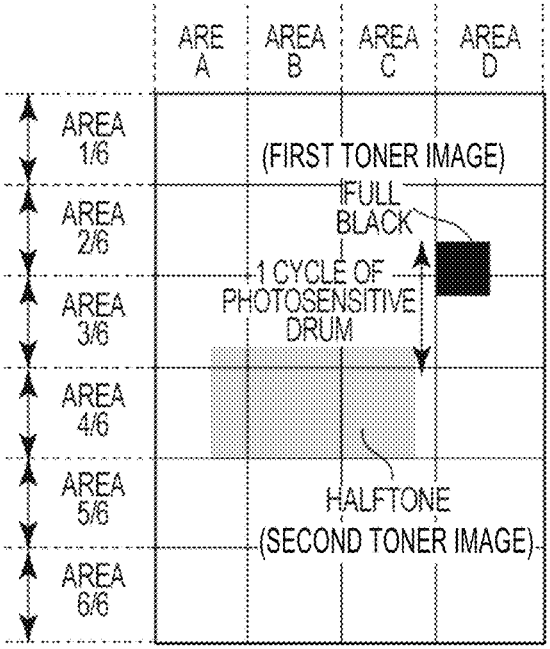
FIG. 6B is a schematic diagram for describing another example of the analyzing method of image information.

Next, the case where image information is analyzed by not only being divided in the conveyance direction of the recording material P, but also in the direction perpendicular to the conveyance direction of the recording material P is described. Note that, in the present example, a laser scanner is used as the exposure apparatus 3, and it is assumed that the scanning direction of the laser scanner has a direction substantially parallel to the direction of an axis of rotation of the photosensitive drum 1 as the main scanning direction, and has the movement direction (conveyance direction of the recording material P) of the surface of the photosensitive drum 1 as the subscanning direction. FIG. 6A and FIG. 6B illustrate the image information of an image in which a full black portion and a halftone image are arranged at the positions that do not overlap with each other with respect to the main scanning direction.

In FIG. 6A, when forming an image on the recording material P of, for example, A4 size (longitudinal feed), the image information is analyzed by being divided into six, an area 1/6 to an area 6/6, in the subscanning direction. When control is performed for the image in FIG. 6A by the aforementioned Methods (1) and (2), control for increasing the transfer current value is performed, respectively. However, in the image in FIG. 6A, since the full black portion and the halftone image are arranged at the positions that do not overlap with each other with respect to the main scanning direction, a ghost image is not generated. That is, normally, it is not necessary to perform control for increasing the transfer current value.

Figure 6C:
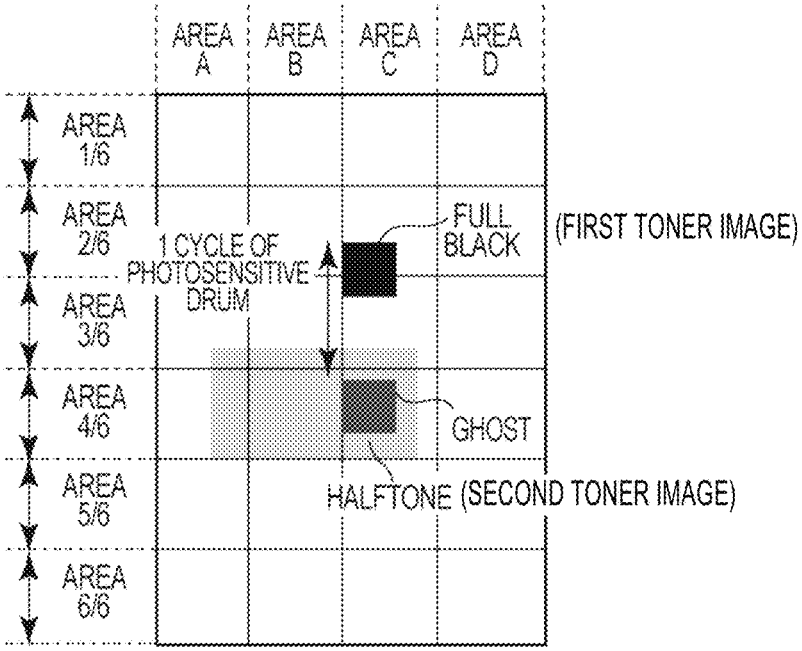
FIG. 6C is a schematic diagram for describing another example of the analyzing method of image information.

On the other hand, in FIG. 6B, the same image information as FIG. 6A is analyzed by being divided into six, the area 1/6 to the area 6/6, in the subscanning direction, and being divided into four, an area A to an area D, in the main scanning direction. The analyzing method of the image information and the feedback method to the control of the transfer current value in this case are described. First, whether or not a halftone image is in each area is determined. Next, when there is a halftone image, and there is a high-contrast image pattern in an area including the position of the halftone image in one cycle of the photosensitive drum 1 before in the subscanning direction, and there is the high-contrast image pattern at the position that overlaps with the halftone image with respect to the main scanning direction, the transfer current value of the area having the high-contrast image pattern in the subscanning direction is increased. According to this method, the changing of the transfer current value is not performed in the image in FIG. 6B. In FIG. 6C, the image information obtained by shifting the full black portion of the image information in FIG. 6B in the main scanning direction is analyzed by the same method as described above. In this case, since the full black portion is at the position that overlaps with the halftone image with respect to the main scanning direction, the transfer current values of the area 2/6 and the area 3/6 are increased.

In this manner, when the image information is divided in both the main scanning direction and the subscanning direction, and the more the number of divisions of the image information is increased, the easier it becomes to balance between the suppression of a ghost image and the other image defects, such as a blank area, and therefore a higher quality image can be obtained.

Note that the number of divisions of image information in the subscanning direction can be determined by taking into consideration, for example, the processing speed in the image processing portion, the process speed of the image forming apparatus 100, and the rising time and falling time of the transfer voltage applied to the transfer roller 12. In addition, the number of divisions of image information in the main scanning direction can be determined by taking into consideration, for example, the processing speed in the image processing portion. The number of divisions of image information is not limited to that described in the present example, and the number of divisions may be further increased, or conversely, the number of divisions may be decreased, depending on the conditions of the above-described image forming apparatus 100. From a viewpoint of making the area where the transfer current value is increased to suppress the generation of a ghost image small, the above-described number of divisions can be a number with which the length of one divided area with respect to the subscanning direction becomes equal to or less than the circumferential length of the photosensitive drum 1. In addition, although the lower limit of the above-described number of divisions may be determined by taking into consideration the above-described factors, a rough standard is, for example, about ten.

In addition, the amount of change in the transfer current value can be adjusted by taking into consideration the suppression of a ghost image, and the ease of generation of other image defects (a blank area, etc.) correlated with the transfer current value, etc. For example, when an image in the area where the transfer current value is changed is an image in which a blank area is not easily generated, the amount of change in the transfer current value can be increased by prioritizing the suppression of a ghost image. On the other hand, when the image is an image in which a blank area is easily generated, considering the balance between the suppression of a ghost image and a blank area, the amount of change in the transfer current value can be made small, or not be changed. Information regarding the image in which a blank area is not easily generated, and the image in which a blank area is easily generated can be set in advance and stored in the ROM 312. The image in which a blank area is not easily generated is a thin line having a small line width less than a predetermined line width (for example, less than 10 dot), a text image formed with a font having a small line width less than a predetermined line width (for example, less than 10 dot), etc. In addition, the image in which a blank area is easily generated is a line having a large line width equal to or more than the above-described predetermined line width, a text image formed with a font having a large line width equal to or more than the above-described predetermined line width, etc.

8. Effects of Present Example

Figure 7:
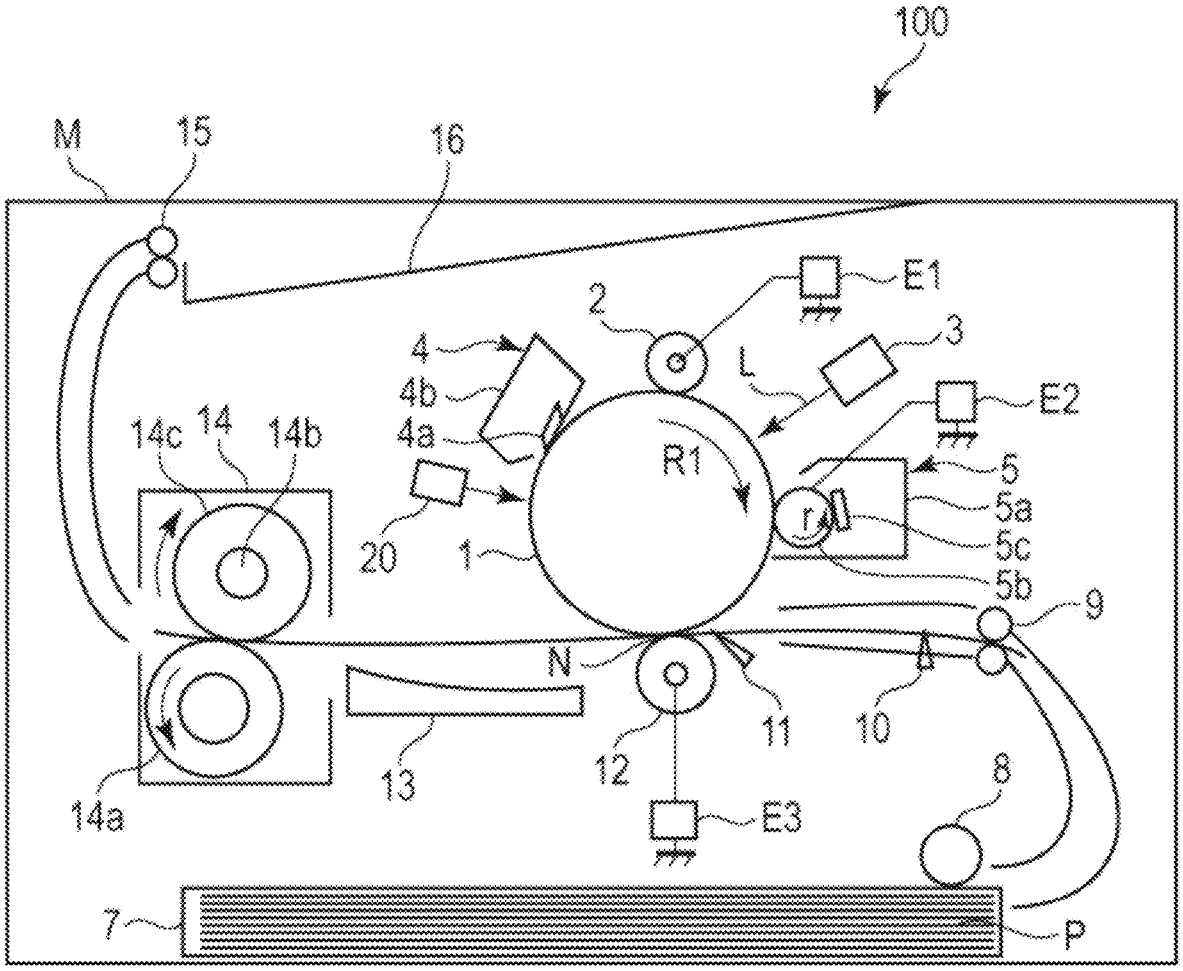
FIG. 7 is a schematic cross-sectional view of an image forming apparatus of a comparison example.

Next, the result of an examination conducted for examining the effects of the present example is described. For comparison with the present example, a similar examination was conducted also for an image forming apparatus of Comparison Example provided with the pre-charge exposure apparatus illustrated in FIG. 7. In the image forming apparatus of Comparison Example illustrated in FIG. 7, the elements having the same or corresponding functions or configurations as those of the image forming apparatus of the present example illustrated in FIG. 1 are denoted by the same references, and a detailed description is omitted. In an image forming apparatus 100 of Comparison Example illustrated in FIG. 7, a pre-charge exposure apparatus 20 as a static elimination unit is provided on the downstream side of the transfer roller 12 and on the upstream side of the cleaning apparatus 4 with respect to the rotation direction of the photosensitive drum 1. At the time of image formation, the surface of the photosensitive drum 1 after the transfer process is uniformly exposed by the pre-charge exposure apparatus 20, and the surface potential of the photosensitive drum 1 before the charging process is substantially zero.

Figure 8A:
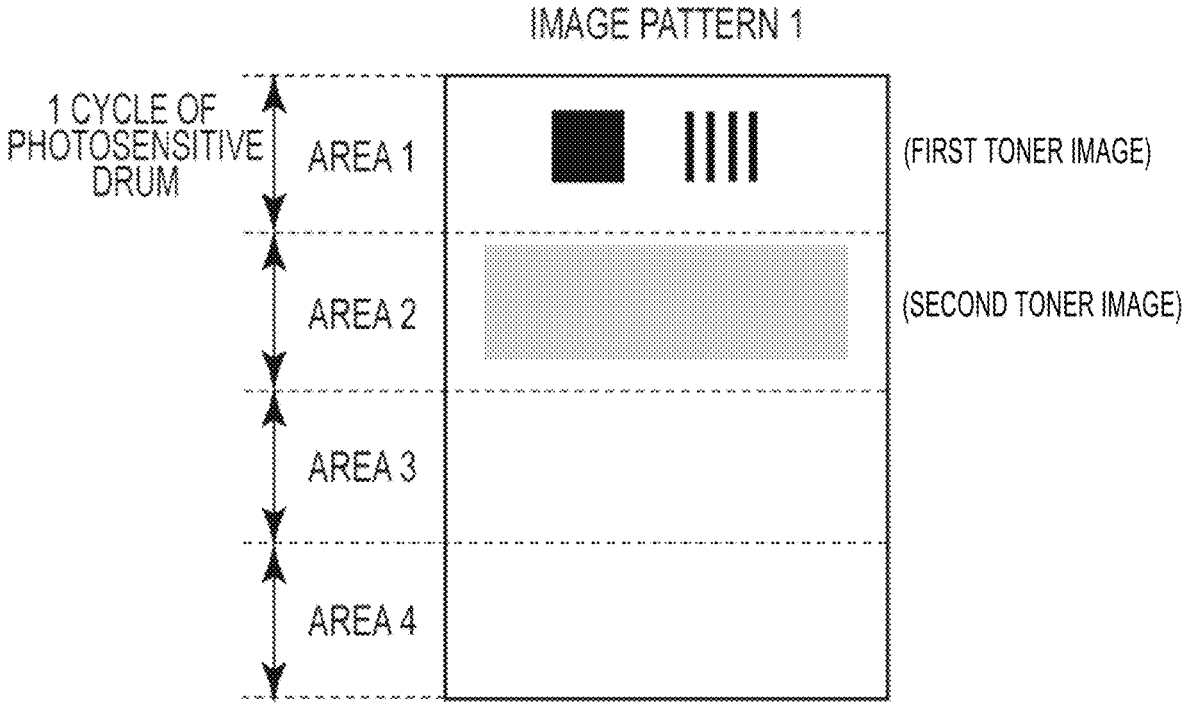
FIG. 8A is a schematic diagram of an image used in an evaluation test.
Figure 8B:
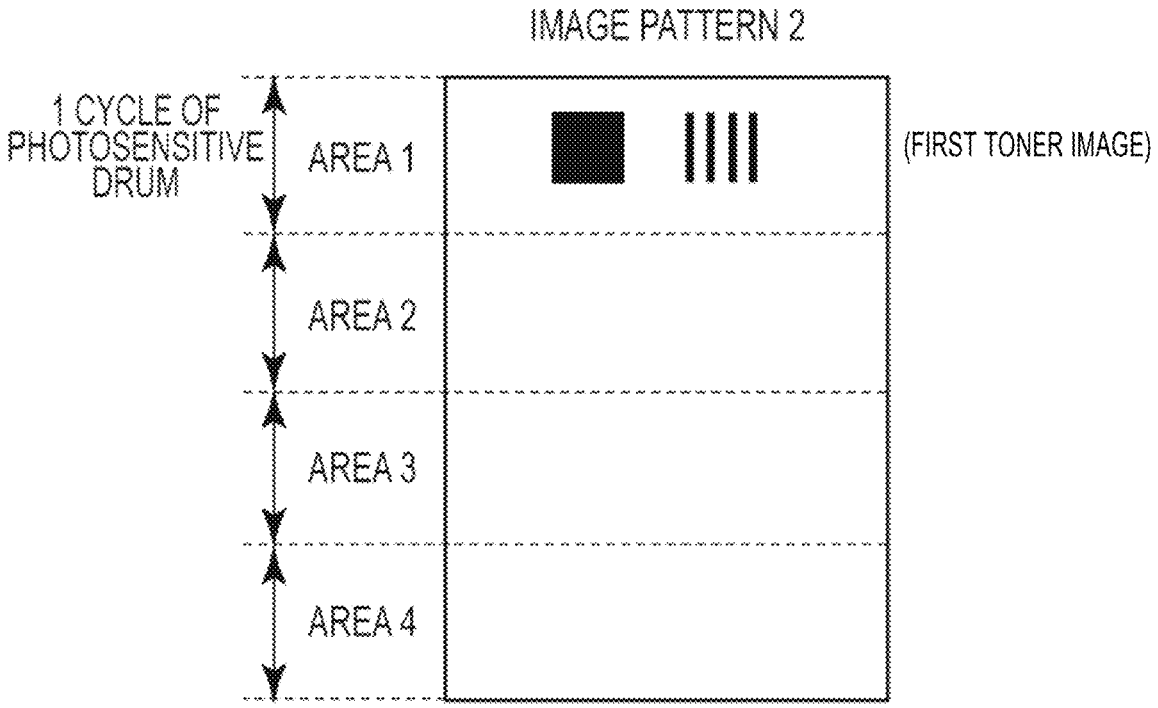
FIG. 8B is a schematic diagram of an image used in the evaluation test.

The examination was conducted by using Office 70 by Canon, Inc. of A4 size as the recording material P. The image forming apparatus 100 was installed in an environment having the temperature of 23° C. and the humidity of 50%, and performed a print operation. In addition, each of an image pattern 1 illustrated in FIG. 8A and an image pattern 2 illustrated in FIG. 8B was printed on one sheet. Here, as illustrated in FIG. 8A and FIG. 8B, image information was divided into four, an area 1 to an area 4, for each cycle (circumferential length) of the photosensitive drum 1 in the conveyance direction of the recording material P. Then, when analyzing the image information and feeding back to the control of the transfer current value according to the present example, the image information was analyzed by being divided into four, the above-described area 1 to area 4. In the image pattern 1, a rectangular patch image as a full black portion, and a plurality of line images along the conveyance direction of the recording material P are arranged in the area 1, and a halftone image having the coverage rate of 40% is arranged in the area 2. Note that, in the image pattern 1, the full black portion is entirely arranged at the position that overlaps with the halftone image with respect to the main scanning direction. In the image pattern 2, although the same full black portion as in the image pattern 1 is arranged in the area 1, the halftone image is not arranged in the area 2.

Table 1 illustrates the results of the image forming apparatus 100 of Comparison Example provided with the pre-charge exposure apparatus 20. In addition, Table 2 illustrates the results for the image forming apparatus 100 having the configuration of the present example. Sensory evaluation by visual observation is performed for each of scattering, a blank area and a ghost image, and the evaluation results are illustrated according to the following standards. Regarding scattering, in a case where scattering was generated at an unacceptable level, the case is indicated by "x (poor)", in a case where scattering was slightly generated, the case is indicated by "Δ (no practical problem)", and in a case where scattering was not generated, the case is indicated by "○ (good)." Regarding a blank area, in a case where a blank area was generated at an unacceptable level, the case is indicated by "x (poor)", in a case where a blank area was slightly generated, the case is indicated by "Δ (no practical problem)", and in a case where a blank area was not generated, the case is indicated by "○ (good)." Regarding a ghost image, in a case where the ghost image is generated, the case is indicated by "x (poor)", and in a case where a ghost image was not generated, the case is indicated by "○ (good)." Here, generally, different from scattering and a blank area, a ghost image is easily visible when the ghost image is generated even slightly. Therefore, regarding a ghost image, the evaluation result is indicated by whether or not there is the generation. In addition, the generation situation of scattering, a blank area and a ghost image is comprehensively determined, and in a case where the evaluation results were "○" in all of the items and had a superior image quality, the case is indicated by "very good", in a case where there is no "x" in the evaluation results of all the items and had a relatively good image quality, the case is indicated by "good", and in case where there is "x" in the evaluation result of any one of the items, the case is indicated by "poor" as having a problem in the image quality.

TABLE 1

(with pre-charge exposure)

| | transfer current value for image pattern 1 [μA] | transfer current value for image pattern 2 [μA] | image pattern 1 scattering | image pattern 1 blank area | image pattern 1 ghost | image pattern 1 determination | image pattern 2 scattering | image pattern 2 blank area | image pattern 2 ghost | image pattern 2 determination |
|---|---|---|---|---|---|---|---|---|---|---|
| control method 1 | 7 | 7 | x | ○ | ○ | poor | x | ○ | ○ | poor |
| control method 2 | 8 | 8 | Δ | ○ | ○ | good | Δ | ○ | ○ | good |
| control method 3 | 9 | 9 | ○ | ○ | ○ | very good | ○ | ○ | ○ | very good |
| control method 4 | 10 | 10 | ○ | Δ | ○ | good | ○ | Δ | ○ | good |
| control method 5 | 11 | 11 | ○ | x | ○ | poor | ○ | x | ○ | poor |

First, the results for the image forming apparatus 100 of Comparison Example provided with the pre-charge exposure apparatus 20 illustrated in Table 1 are described. In a control method 1 to a control method 5, the transfer current values illustrated in Table 1 were respectively set for all areas of the recording material P for both the image pattern 1 and the image pattern 2. In the image forming apparatus 100 of Comparison Example, since the surface potential of the photosensitive drum 1 before the charging process was made uniform by the pre-charge exposure apparatus 20, a ghost image was not generated. Therefore, the transfer current value may be set to a current value with which scattering and a blank area were not generated. That is, the transfer current values of the control method 3 with which the comprehensive evaluations were "very good" for both the image pattern 1 and the image pattern 2 can be set.

Next, the results for the image forming apparatus 100 having the configuration of the present example illustrated in Table 2 are described. The control method 1 to the control method 5 are control methods for comparison with the control method according to the present example, and the transfer current values illustrated in Table 2 were set for all areas of the recording material P for both the image pattern 1 and the image pattern 2. The control method 6 is a control method according to the present example (especially, the aforementioned Method (2)), and the transfer current value were controlled according to image information. That is, for the image pattern 1, the transfer current value for the area 1 was set to be higher than the transfer current values for the other areas 2 to 4. On the other hand, for the image pattern 2, the same transfer current value for the other areas 2 to 4 of the above-described image pattern 1 was set for all areas of the recording material P.

As illustrated in Table 2, in the control method 1 to the control method 5, in order to achieve the comprehensive evaluation "very good" for the image pattern 2, it is necessary to set to the transfer current values of the control method 3. However, for the image pattern 1, when the transfer current value of the control method 3 is set, since a ghost image is generated, the comprehensive evaluation is "poor." In order to suppress the generation of a ghost image for the image pattern 1, it is necessary to set the transfer current value of the control method 4, which is higher than the transfer current value of the control method 3. However, when the transfer current value of the control method 4 is set for the image pattern 2, since a slight blank area is generated, the comprehensive evaluation is "good." That is, in the case of the image forming apparatus 100 having the configuration

TABLE 2

(without pre-charge exposure)

| | transfer current value for area 1 of image pattern 1 [μA] | transfer current value for area 2 to area 4 of image pattern 1 and all areas of image pattern 2 [μA] | image pattern 1 scattering | image pattern 1 blank area | image pattern 1 ghost | image pattern 1 determination | image pattern 2 scattering | image pattern 2 blank area | image pattern 2 ghost | image pattern 2 determination |
|---|---|---|---|---|---|---|---|---|---|---|
| control method 1 | 7 | 7 | x | ○ | x | poor | x | ○ | ○ | poor |
| control method 2 | 8 | 8 | Δ | ○ | x | poor | Δ | ○ | ○ | good |
| control method 3 | 9 | 9 | ○ | ○ | x | poor | ○ | ○ | ○ | very good |
| control method 4 | 10 | 10 | ○ | Δ | ○ | good | ○ | Δ | ○ | good |
| control method 5 | 11 | 11 | ○ | x | ○ | poor | ○ | x | ○ | poor |
| control method 6 (present example) | 10 | 9 | ○ | Δ | ○ | good | ○ | ○ | ○ | very good |

of the present example, when the transfer current values that merely suppress the generation of a ghost image in all areas of the recording material P are set as in the control method 4, the image quality of an image without a possibility of generation of a ghost image, such as the image pattern 2, is degraded.

On the other hand, in the control method 6 according to the present example, the transfer current value is set to 9 μA in all areas of the recording material P for the image pattern 2 without a possibility of generation of a ghost image. Then, for the image pattern 1 having a possibility of generation of a ghost image, the transfer current value is set to 10 μA in the area 1, and the transfer current value is set to 9 μA in the other areas 2 to 4. Accordingly, the comprehensive evaluation "good" can be achieved by suppressing the generation of a ghost image for the image pattern 1, while achieving the comprehensive evaluation "very good" for the image pattern 2. That is, with the control method 6 according to the present example, printing can be performed with a higher quality than in a case where the same transfer current value is set for all areas of the recording material P irrespective of an image pattern.

In this manner, the image forming apparatus 100 of the present example can form an image on the recording material P whose length in the conveyance direction is longer than the circumferential length of the photosensitive member 1. Then, the image forming apparatus 100 includes the controller (printer control apparatus) 304 that can perform the following control. That is, in a case where, after forming a first toner image on the photosensitive member 1, a second toner image to be transferred on the same recording material P as the first toner image is formed on the photosensitive member 1, and the first toner image is formed in an area of the photosensitive member 1 including at least a part of the position of the second toner image one cycle of the surface of the photosensitive member 1 before with respect to the movement direction, the controller 304 can change the value of the transfer current at the time of transferring the first toner image to the recording material (transfer-receiving member) P between a first value, and a second value having a greater absolute value than the first value, based on the image information regarding the second toner image.

In the present example, when the second toner image is a halftone image, the controller 304 sets the value of the transfer current at the time of transferring the first toner image to the recording material P to the second value. Here, typically, a halftone image is an image having the coverage rate equal to or greater than 5% and equal to or less than 80%. Additionally, when, in addition to the above-described second toner image being a halftone image, the first toner image is an image pattern further satisfying a predetermined condition that is set in advance, the controller 304 may set the value of the transfer current at the time of transferring the first toner image to the recording material P to the second value. Here, typically, the image pattern satisfying the above-described predetermined condition includes at least one of a line image, a text image, and an isolated solid image. Additionally, when, in addition to the above-described second toner image being a halftone image (and further, the first toner image being an image pattern satisfying the predetermined condition), the first toner image and the second toner image are formed at the positions at which at least a part of each of the first toner image and the second toner image overlap with each other with respect to the direction substantially perpendicular to the movement direction of the surface of the photosensitive member 1, the controller 304 may set the value of the transfer current at the time of transferring the first toner image to the recording material P to the second value. Additionally, in the present example, when the area of the photosensitive member 1 on which a toner image to be transferred to one recording material P may be formed over a plurality of cycles of the photosensitive member 1 is divided into a plurality of divided areas with respect to the movement direction of the surface of the photosensitive member 1, the controller 304 can change the value of the transfer current for each period during which each divided area passes through the transfer position N. At this time, the length of each of the plurality of divided areas with respect to the movement direction of the surface of the photosensitive member 1 can be equal to or less than the circumferential length of the photosensitive member 1.

As described above, according to the present example, the generation of a ghost image can be suppressed without using a pre-charge exposure apparatus. Accordingly, the generation of a ghost image can be suppressed with a simple configuration that is advantageous for reduction in size, reduction in weight, and reduction in cost.

Example 2

Next, other examples of the present disclosure are described. In an image forming apparatus of the present example, the elements having the same or corresponding functions or configurations as those of the image forming apparatus of Example 1 are denoted by the same references as those of the image forming apparatus of Example 1, and a detailed description is omitted.

1. Image Forming Apparatus of Cleaner-Less Process

Figure 9:
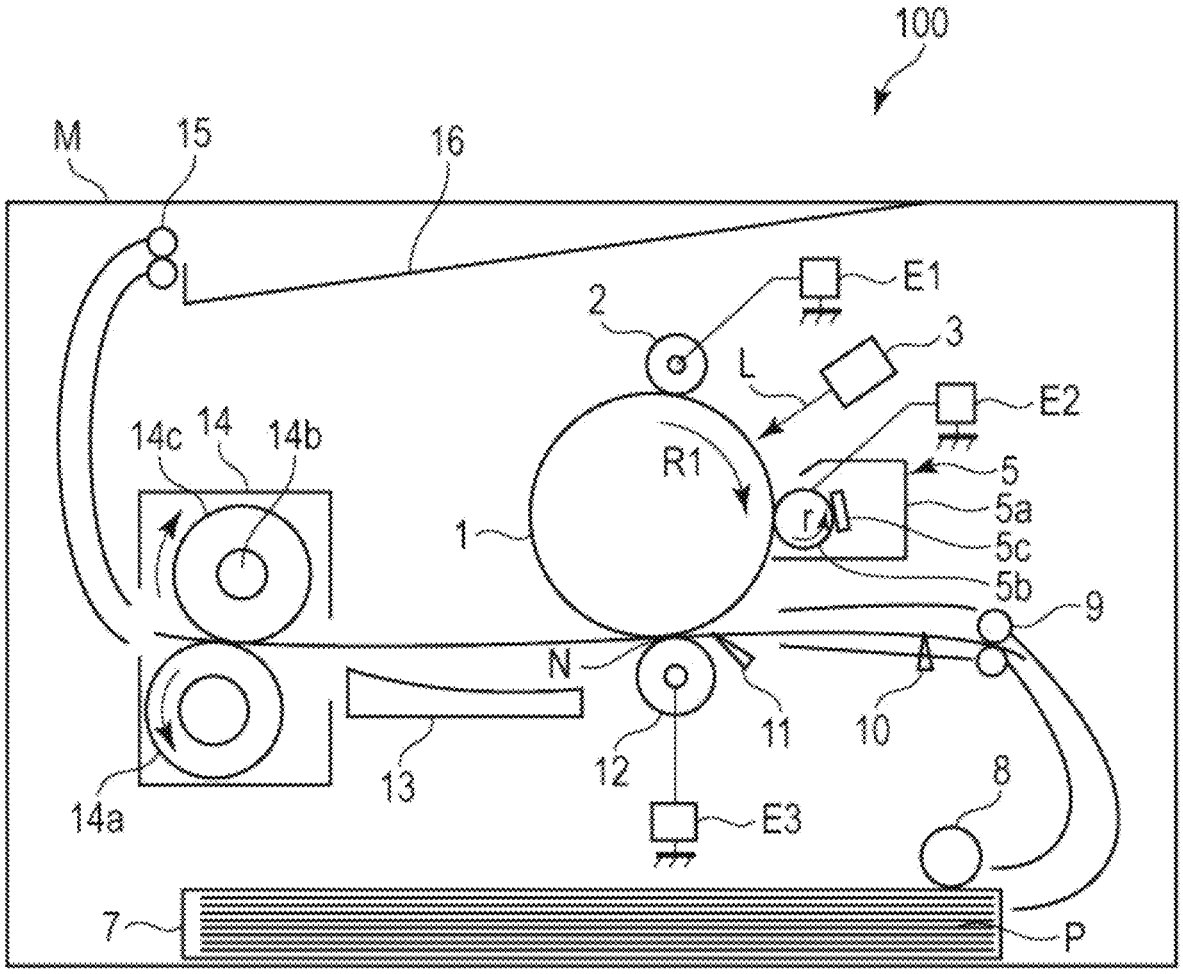
FIG. 9 is a schematic cross-sectional view of an image forming apparatus of another example.

FIG. 9 is a schematic cross-sectional view of the image forming apparatus 100 of the present example. The image forming apparatus 100 of the present example employs a cleaner-less process, and does not include a special cleaning apparatus for cleaning the surface of the photosensitive drum 1 after the transfer process. The transfer residual toner remaining on the surface of the photosensitive drum 1 after the transfer process is charged to the negative polarity, which is the normal charging polarity, by the charging roller 2, simultaneous development cleaning is performed by the developing roller **5*b*, and collected in the development container 5*a*. That is, the transfer residual toner adhering to the non-image portion (non-exposed portion) on the photosensitive drum 1 moves to the developing roller 5*b*, and is collected in the development container 5*a* by the potential difference between the development voltage applied to the developing roller 5*b* and the surface potential (non-exposed portion potential) of the photosensitive drum 1. In addition, the transfer residual toner adhering to the image portion (exposed portion) on the photosensitive drum 1** is conveyed to the transfer NIP N as is, and transferred to the recording material P as a toner constituting an image.

Here, in the cleaner-less process, in order to improve the collectability of the transfer residual toner, it is desired to increase a back contrast potential $Vback=|Vd-Vdc|$, which is the potential difference between a potential Vdc of the developing roller **5*b*, and a non-exposed portion potential Vd of the photosensitive drum 1. Note that the back contrast potential Vback is also called the recovery bias. By increasing Vback, an electric field in the direction that moves the toner charged to the negative polarity, which is the normal charging polarity, formed at a developing position from the photosensitive drum 1 to the developing roller 5*b* is increased. Therefore, an electric force that pulls back, to the developing roller 5*b*, the transfer residual toner after passing through the charging position where charging of the surface of the photosensitive drum 1 by the charging roller 2 is performed becomes high, and the transfer residual toner can be easily collected by the developing roller 5***b*. In the present example, the simultaneous development cleaning is performed by setting Vd=−700V and Vdc=−300V, and setting Vback=400V. On the other hand, when Vback is increased too high, so-called "fogging" may be generated in which the polarity of the toner coated on the developing roller 5*b* is reversed, and the toner moves to the non-image portion on the photosensitive drum 1. Therefore, it is desired to determine Vback in consideration of the balance between the collectability of the transfer residual toner and fogging.

However, when there is too much transfer residual toner remaining on the photosensitive drum 1, a so-called "ghost image" may be generated that appears in an image pattern of the next cycle, since the transfer residual toner cannot be fully collected at the developing position. Therefore, in the image forming apparatus 100 employing the cleaner-less process, in order to suppress the generation of a ghost image, it is desired to efficiently transfer the toner to the recording material P in the transfer NIP N, so as to leave the transfer residual toner as little as possible.

2. Determination Method of Transfer Current Value in Cleaner-Less Process

It is desired to determine the transfer current value in the image forming apparatus 100 employing the cleaner-less process in consideration of the transfer efficiency of a toner in the transfer NIP N, and the sharpness of a line image or a text image.

First, the transfer efficiency is an indicator indicating the extent to which a toner image formed on the photosensitive drum 1 is transferred to the recording material P by the transfer nip N. When it is assumed that the weight of a toner on the photosensitive drum 1 before the transfer process is Tm1 [g], and the weight of the transfer residual toner remaining on the photosensitive drum 1 after the transfer process is Tm2 [g], the transfer efficiency Tp [%] is represented by the following formula.

$$Tp=\{(Tm1-Tm2)/Tm1\}\times 100$$

Figure 10:
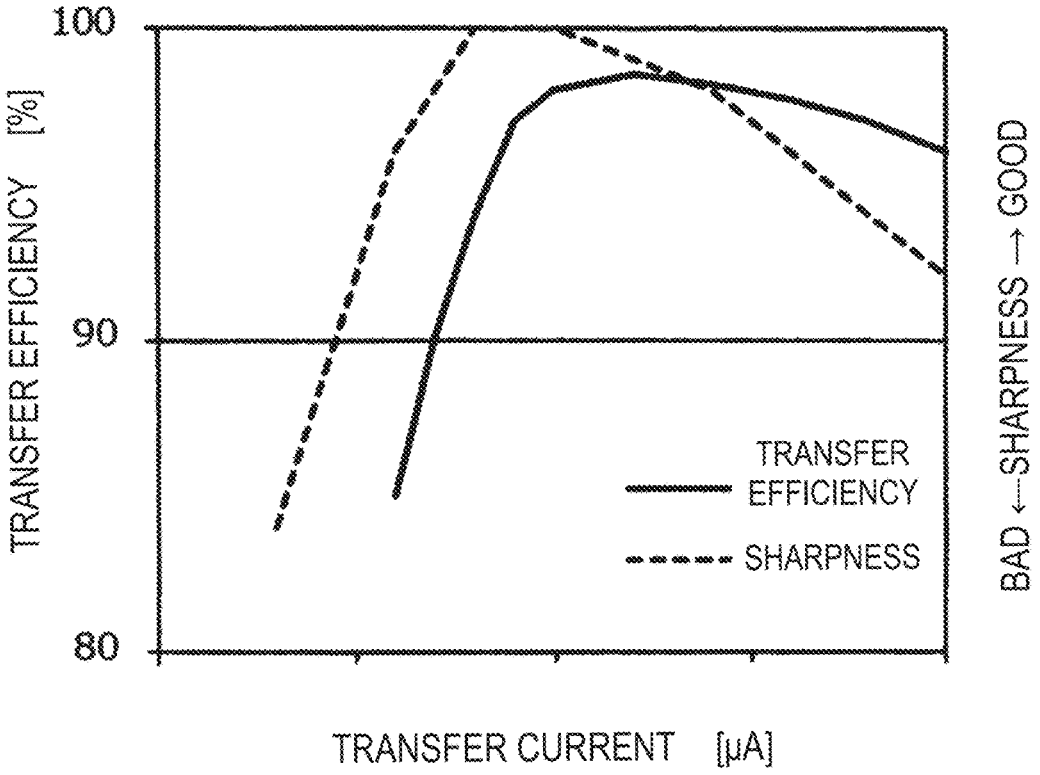
FIG. 10 is a graph illustrating the relationship among a transfer efficiency, the sharpness of an image, and a transfer-current value.

Next, the sharpness of a line image or a text image is a measure representing the clarity of a fine portion of the line image or the text image. FIG. 10 schematically illustrates the relationship among the transfer efficiency Tp [%], the sharpness of an image, and the transfer current value. A continuous line represents the relationship between the transfer efficiency Tp [%] and the transfer current value, and a broken line (a second axis) represents the relationship between the sharpness and the transfer current value. When the transfer current value is too low, the transfer efficiency is decreased, and the transfer residual toner is generated, since the toner image on the photosensitive drum 1 cannot be fully transferred to the recording material P. On the other hand, the transfer efficiency is also decreased when the transfer current value is too high, the charging polarity of a toner once transferred to the recording material P from the photosensitive drum 1 is reversed, and the transfer residual toner is generated by so-called re-transferring in which the toner moves onto the photosensitive drum 1 again. In addition, when the transfer current value is too low, the sharpness is worsened by an image deficit due to an insufficient transfer efficiency. On the other hand, when the transfer current value is too high, the sharpness is also worsened, since an image deficit or a position shift is generated due to abnormal discharge in the transfer NIP N.

That is, it is desired to set the transfer current value so that the sharpness becomes as good as possible, while maintaining the transfer efficiency that can collect the transfer residual toner by the simultaneous development cleaning.

Note that the relationship among the transfer efficiency, the sharpness, and the transfer current value as illustrated in FIG. 10 varies according to, for example, the toner, the basis weight of paper as the recording material P, the electric resistance, the image pattern, and the environment (temperature, humidity, etc.) of the image forming apparatus 100 at the time of performing image formation. Therefore, as described in Example 1, an optimum transfer current value can be set according to these conditions. However, in order to facilitate the understanding of the present disclosure, a description is given by assuming that the conditions other than the image pattern, such as the toner, the type of the recording material P, and the environment of the image forming apparatus 100, are constant, and the transfer current value is not changed according to these.

3. Control of Transfer Current Value According to Image Information

Next, the control of the transfer current value according to image information in the present example is described. In the present example, the image forming apparatus 100 adjusts the transfer process conditions (more particularly, the transfer current value) based on image information to improve the transfer efficiency, and maintains the collectability of the transfer residual toner by the simultaneous development cleaning in the next cycle of the photosensitive drum 1.

As previously described, in the cleaner-less process, it is desired to increase Vback in order to improve the collectability of the transfer residual toner. However, a sufficient Vback may not be set, when there is a halftone image in the next cycle of the photosensitive drum 1, etc. In this case, the transfer residual toner cannot be sufficiently collected, and a ghost image may be generated on the halftone image.

Figure 11A:
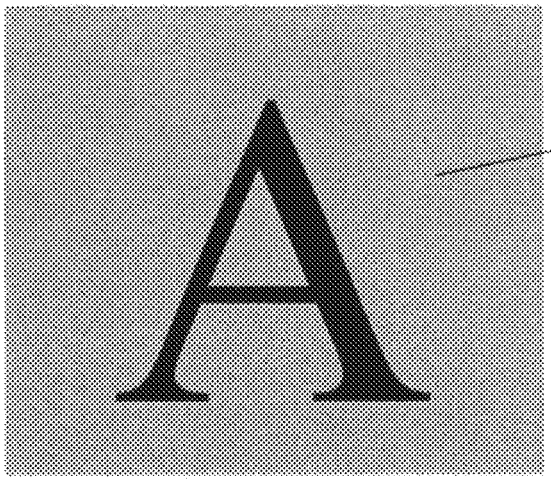
FIG. 11A is a schematic diagram for describing the surface potential of a photosensitive drum of a halftone image.
Figure 11B:
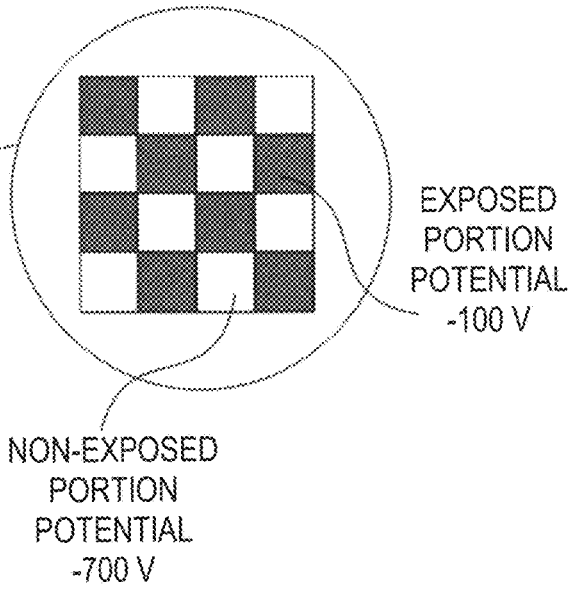
FIG. 11B is a schematic diagram for describing the surface potential of the photosensitive drum of the halftone image.

FIG. 11A is a diagram illustrating an example of a halftone image. FIG. 11B is an enlarged view of a halftone portion in FIG. 11A. In the present example, the exposed portion potential (image portion potential) Vl is −100V, and the surface potential of the photosensitive drum 1 of the halftone image portion in a case where an electrostatic latent image of the halftone image having the coverage rate of, for example, 50% is formed will be as illustrated in FIG. 11B. In FIG. 11B, although the non-exposed portion potential (non-image portion potential) Vd is −700V, the exposed portion potential (image portion potential) is −100V, and when the surface potential of the photosensitive drum 1 of the halftone-image portion is averaged, the surface potential is about −350V. In this case, Vback becomes significantly low, and the collectability of the transfer residual toner is decreased.

Accordingly, when there is a halftone image in the next cycle of the photosensitive drum 1, it is desired to further improve the transfer efficiency to lessen the transfer residual toner. As previously described, although it is desired to determine the transfer current value in consideration of the transfer efficiency and the sharpness of an image, from a viewpoint of the image quality, it is more important to suppress the generation of the ghost image that is easily visible than to increase the sharpness. Therefore, when there is a halftone image in the next cycle of the photosensitive drum 1, the transfer current value with which a ghost image is not generated can be set.

Therefore, in the present example, image information is obtained before performing the transfer process, and the transfer current value is set based on the image information.

Note that the halftone image here is an image having a coverage rate equal to or more than 5% and equal to or less than 80% in a case where it is assumed that, for example, the coverage rate of an area filed with the maximum concentration (100% concentration) of one pixel is 100%.

4. Analyzing Method of Image Information and Feedback Method to Control of Transfer Current Value Next, the analyzing method of image information and the feedback method to the control of transfer current value in the present example are described.

Figure 12A:
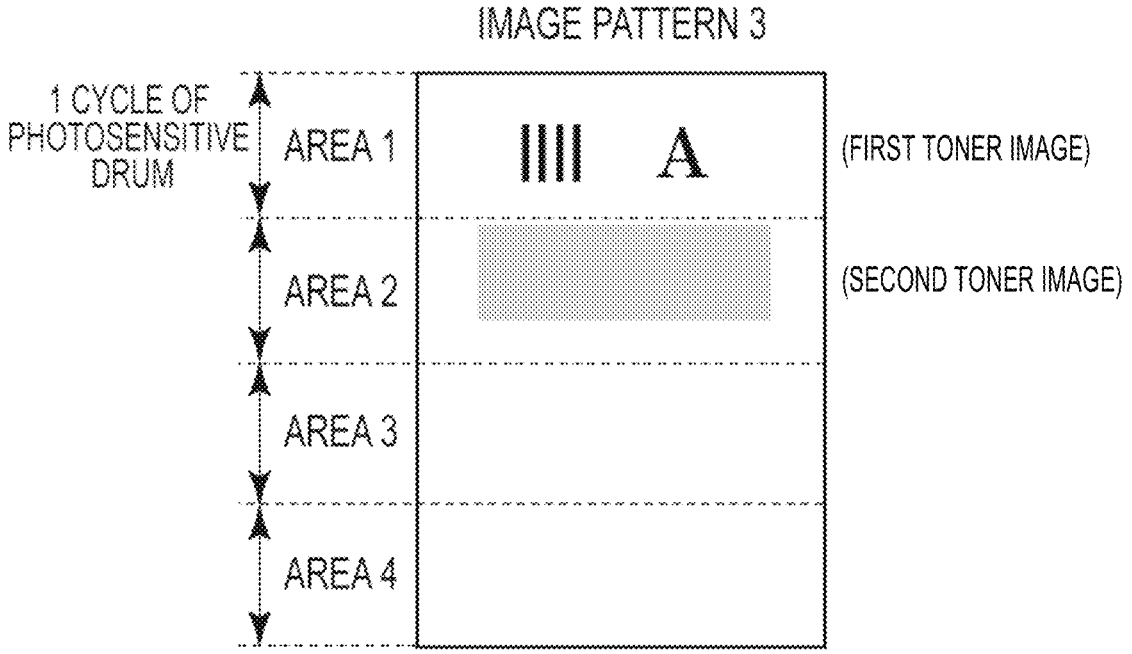
FIG. 12A is a schematic diagram of an image used in an evaluation test.
Figure 12B:
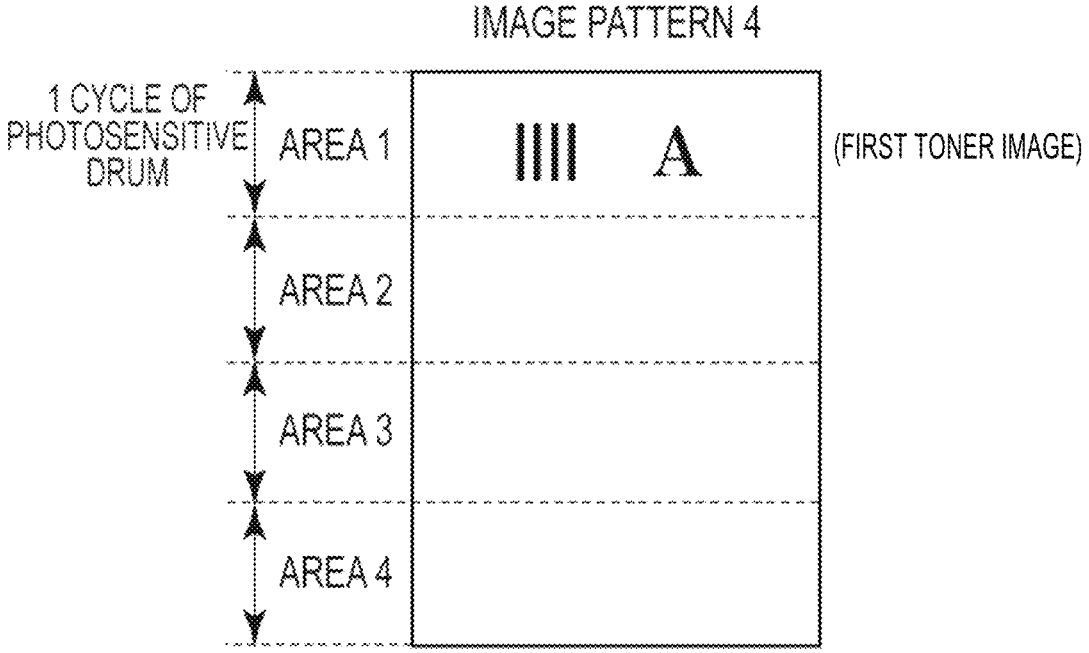
FIG. 12B is a schematic diagram of an image used in the evaluation test.

In the present example, when forming an image on the recording material P of, for example, A4 size (longitudinal feed) as illustrated in FIG. 12A and FIG. 12B, image information is analyzed by being divided into four, an area 1 to an area 4, in the conveyance direction of the recording material P. In the present example, this corresponds to dividing the image information into four, the area 1 to the area 4, in the conveyance direction of the recording material P for each cycle (circumferential length) of the photosensitive drum 1. The analyzing method of the image information and the feedback method to the control of the transfer current value in this case are described. First, whether or not there is a halftone image in each area is determined. Next, when there is an image pattern in an area in the subscanning direction including the position of the halftone image one cycle of the photosensitive drum 1 before, the transfer current value of the area in the subscanning direction including the image pattern is increased. In the present example, this image pattern is not limited to a high-contrast image pattern, and any image pattern can cause a ghost image. However, since a high-contrast image pattern tends to have a large amount of a toner, and a large amount of the transfer residual toner, whether or not there is a high-contrast image may be determined as in Example 1. According to the above-described method, the transfer current value for the area 1 is increased for the image in FIG. 12A, and the changing of the transfer current value is not performed for the image in FIG. 12B.

Note that the image information may also be analyzed by being divided in the main scanning direction, as described in Example 1. In this case, when there is an image pattern in an area in the subscanning direction including the position of a halftone image one cycle of the photosensitive drum 1 before, and the image pattern is at the position that overlaps with the halftone image with respect to the main scanning direction, the transfer current value of an area in the subscanning direction including the image pattern is increased. In addition, as described in Example 1, the suppression of a ghost image and the sharpness of an image can be more easily balanced by increasing the number of divisions of image information.

5. Effects of Present Example

Next, the result of an examination conducted for examining the effects of the present example is described. The examination was conducted by using Office 70 by Canon, Inc. of A4 size as the recording material P. The image forming apparatus 100 was installed in an environment having the temperature of 23° C. and the humidity of 50%, and performed a print operation. In addition, each of an image pattern 3 illustrated in FIG. 12A and an image pattern 4 illustrated in FIG. 12B was printed on one sheet. As previously described, here, as illustrated in FIG. 12A and FIG. 12B, image information was divided into four, an area 1 to an area 4, for each cycle (circumferential length) of the photosensitive drum 1 in the conveyance direction of the recording material P. Then, when analyzing the image information and feeding back to the control of the transfer current value according to the present example, the image information was analyzed by being divided into four, the above-described area 1 to area 4. In the image pattern 3, a plurality of line images along the conveyance direction of the recording material P as a full black portion, and a text "A" are arranged in the area 1, and a halftone image having the coverage rate of 40% is arranged in the area 2. Note that, in the image pattern 3, the full black portion is entirely arranged at the position that overlaps with the halftone image with respect to the main scanning direction. In the image pattern 4, although the same full black portion as in the image pattern 3 is arranged in the area 1, the halftone image is not arranged in the area 2.

The result is illustrated in Table 3. Sensory evaluation by visual observation is performed for each of a ghost image and the sharpness of an image, and the evaluation results are illustrated according to the following standards. Regarding a ghost image, in a case where the ghost image is generated, the case is indicated by "x (poor)", and in a case where a ghost image was not generated, the case is indicated by "○ (good)." Regarding the sharpness of an image, in a case where a visible image deficit or position shift was not generated, the case is indicated by "○ (good)", in a case where a slight image deficit or position shift was generated, the case is indicated by "Δ (no practical problem)", and in a case where an image deficit or position shift was generated at an unacceptable level, the case is indicated by "x (poor)." In addition, the generation situation of a ghost image and the sharpness are comprehensively determined, and in a case where the evaluation results were "○" in all of the items and had a superior image quality, the case is indicated by "very good", in a case where there is no "x" in all the items and had a relatively good image quality, the case is indicated by "good", and in case where there is "x" in the evaluation result of any one of the items, the case is indicated by "poor" as having a problem in the image quality.

TABLE 3

| | transfer current value for area 1 of image pattern 3 | transfer current value for area 2 to area 4 of image pattern 3 and all areas of image | image pattern 3 | | | image pattern 4 | | |
|---|---|---|---|---|---|---|---|---|
| | [μA] | pattern 4 [μA] | sharpness | ghost | determination | sharpness | ghost | determination |
| control method 7 | 12 | 12 | ○ | x | poor | ○ | ○ | poor |
| control method 8 | 13 | 13 | ○ | x | poor | ○ | ○ | good |

TABLE 3-continued

| | transfer current value for area 1 of image pattern 3 [μA] | transfer current value for area 2 to area 4 of image pattern 3 and all areas of image pattern 4 [μA] | image pattern 3 | | | image pattern 4 | | |
|---|---|---|---|---|---|---|---|---|
| | | | sharpness | ghost | determination | sharpness | ghost | determination |
| control method 9 | 14 | 14 | ○ | x | poor | ○ | ○ | very good |
| control method 10 | 15 | 15 | Δ | ○ | good | Δ | ○ | good |
| control method 11 | 16 | 16 | x | ○ | poor | x | ○ | poor |
| control method 12 (present example) | 15 | 14 | Δ | ○ | good | ○ | ○ | very good |

A control method 7 to a control method 11 are control methods for comparison with the control method according to the present example, and the transfer current values illustrated in Table 3 were respectively set for all areas of the recording material P for both the image pattern 3 and the image pattern 4. The control method 12 is the control method according to the present example, and controlled the transfer current value according to image information. That is, for the image pattern 3, the transfer current value for the area 1 was set to be higher than the transfer current values for the other areas 2 to 4. On the other hand, for the image pattern 4, the same transfer current value for the other areas 2 to 4 of the above-described image pattern 3 was set for all areas of the recording material P.

As illustrated in Table 3, in the control method 7 to the control method 11, in order to achieve the comprehensive evaluation "very good" for the image pattern 4, it is necessary to set to the transfer current values of the control method 9. However, for the image pattern 3, when the transfer current value of the control method 9 is set, since a ghost image is generated, the comprehensive evaluation is "poor." In order to suppress the generation of a ghost image for the image pattern 3, it is necessary to set the transfer current value of the control method 10, which is higher than the transfer current value of the control method 9. However, when the transfer current value of the control method 10 is set for the image pattern 4, since a slight image deficit is generated, the comprehensive evaluation is "good." That is, in the case of the image forming apparatus 100 having the configuration of the present example, when the transfer current values that merely suppress the generation of a ghost image in all areas of the recording material P are set as in the control method 10, the image quality of an image without a possibility of generation of a ghost image, such as the image pattern 4, is degraded.

On the other hand, in the control method 12 according to the present example, the transfer current value is set to 14 μA in all areas of the recording material P for the image pattern 4 without a possibility of generation of a ghost image. Then, for the image pattern 3 having a possibility of generation of a ghost image, the transfer current value is set to 15 μA in the area 1, and the transfer current value is set to 14 μA in the other areas 2 to 4. Accordingly, the comprehensive evaluation "good" can be achieved by suppressing the generation of a ghost image for the image pattern 3, while achieving the comprehensive evaluation "very good" for the image pattern 4. That is, with the control method 12 according to the present example, printing can be performed with a higher quality than in a case where the same transfer current value is set for all areas of the recording material P irrespective of an image pattern.

As described above, according to the present example, the generation of a ghost image can be suppressed in the image forming apparatus 100 employing the cleaner-less system.

OTHERS

In the above, although the present disclosure has been described based on specific examples, the present disclosure is not limited to the above-described examples.

In the above-described examples, although the transfer voltage has been described as being controlled by the constant current control, the transfer voltage may be controlled by the constant voltage control that controls the output voltage value of the transfer power supply to be constant. In this case, the constant voltage control can be performed on the transfer voltage with a voltage value determined so as to achieve a predetermined target transfer current value according to, for example, the type of the recording material, the environment of the image forming apparatus, etc. Then, when the transfer current value is changed based on image information as in the above-described examples, the voltage value can be changed only by the amount corresponding to a predetermined amount of change from the above-described target transfer current value.

In the above-described examples, although the photosensitive member has been described as a drum-like (cylindrical) member, the photosensitive member may be a rotation member (rotary member) having another rotatable form, such as an endless belt-like member wound around a plurality of support rollers. Additionally, in the above-described example, although the charging member has been described as the roller-like member, the charging member may be a rotation member (rotary member) having another rotatable form, such as an endless belt-like member wound around a plurality of support rollers. The same applies to the developing member and the transfer member. When using an endless belt-like member, for example, one of a plurality of support rollers can be made to abut against the photosensitive member via the belt.

In the above-described examples, although the case where the non-magnetic single-component developer is used as the developer has been described, the present disclosure can also be applied to the case where a magnetic single-component developer is used as the developer, and the same effects as in the above-described example can be obtained. Additionally, in the above-described examples, although the developing member is arranged to contact the photosensitive member, the developing member may be arranged close to the photosensitive member.

Figure 14:
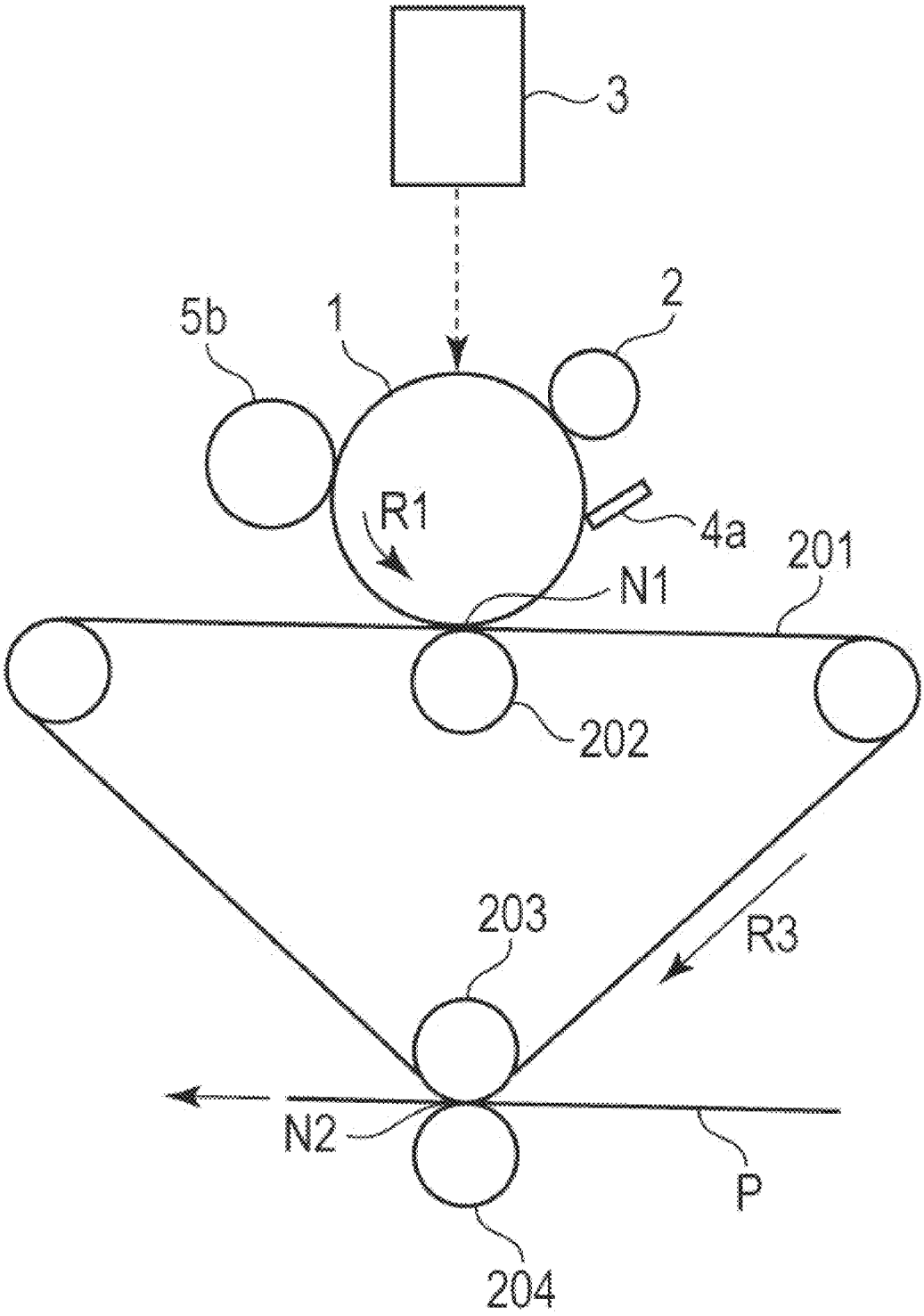
FIG. 14 is a schematic diagram for describing an image forming apparatus of the intermediate transfer system.

Additionally, in the above-described example, the image forming apparatus directly transfers the toner image from the photosensitive member to the recording material. The present disclosure is not limited to this, and can also be applied to an image forming apparatus of the intermediate transfer system. FIG. 14 is a schematic diagram illustrating the schematic configuration of an image forming apparatus of the intermediate transfer system. In FIG. 14, the elements having the same or corresponding functions or configurations as those of the image forming apparatus of the above-described examples are denoted by the same references. The image forming apparatus 100 of the intermediate transfer system includes, as a transfer-receiving member, an intermediate transfer belt 201, which is an intermediate transfer body including an endless belt, opposing the photosensitive drum 1. The intermediate transfer belt 201 is wound around a plurality of support rollers (stretching roller), and is stretched by a predetermined tension. The intermediate transfer belt 201 is rotated in a R3 direction in the figure (rotational movement) when a driving roller of the plurality of support rollers is rotationally driven. A primary transfer roller 202 including a roller-like member as a primary transfer member (transfer current supplying member) is often arranged on the inner periphery surface side of the intermediate transfer belt 201 to opposite to the photosensitive drum 1. Additionally, in many cases, a secondary transfer outside roller 204 including a roller-like member is often arranged at the position opposing to a secondary transfer internal roller 203 of the plurality of support rollers on the outer periphery surface side of the intermediate transfer belt 201. The intermediate transfer belt 201 is sandwiched by the secondary transfer internal roller 203 and the secondary transfer outside roller 204. As in the above-described examples, the primary transfer of a toner image formed on the photosensitive drum 1 onto the intermediate transfer belt 201 is performed in a primary transfer NIP N1, which is a contact portion between the photosensitive drum 1 and the intermediate transfer belt 201, by the effect of the primary transfer roller 202. At the time of the primary transfer, a primary transfer current is supplied to the primary transfer NIP N1 by applying a primary transfer voltage (primary transfer bias), which is a DC voltage having the reversed polarity of the normal charging polarity of a toner, to the primary transfer roller 202. In addition, the secondary transfer of the toner image subjected to the primary transfer onto the intermediate transfer belt 201 is performed onto the recording material P that is sandwiched and conveyed by the intermediate transfer belt 201 and the secondary transfer outside roller 204 in a secondary transfer NIP N2, which is a contact portion between the intermediate transfer belt 201 and the secondary transfer outside roller 204. At the time of the secondary transfer, for example, a secondary transfer voltage (secondary transfer bias), which is a DC voltage having the reversed polarity of the normal charging polarity of a toner, is applied to the secondary transfer outside roller 204. Note that, although illustration is omitted in FIG. 14, the intermediate transfer system is often employed in a so-called tandem-type color image forming apparatus in which a plurality of photosensitive drums 1 (and process units around the photosensitive drums 1) are arranged along the movement direction of the surface of the intermediate transfer belt 201. Also in the image forming apparatus 100 of such an intermediate transfer system, a ghost image may be generated as in the above-described Example 1 or Example 2. Therefore, also in the image forming apparatus 100 of the intermediate transfer system, the same effects as in the above-described examples can be obtained by applying the present disclosure.

In addition, similarly, the present disclosure can also be applied to an image forming apparatus provided with a recording material carrier, such as a recording material carrying belt including an endless belt, instead of the intermediate transfer body in the image forming apparatus of the above-described intermediate transfer system. In this image forming apparatus, a toner image formed on a photosensitive member is transferred onto a recording material carried and conveyed by the recording material carrier by applying a transfer voltage (transfer bias) to the recording material carrier via a voltage application member (transfer roller, etc.). Also in an image forming apparatus provided with such a recording material carrier, a ghost image may be generated as in the above-described Example 1 or Example 2. Therefore, also in such an image forming apparatus, the same effects as in the above-described examples can be obtained by applying the present disclosure.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-164955, filed Sep. 10, 2019, which is hereby incorporated by reference herein in its entirety.

What is claimed is:

1. An image forming apparatus, comprising:

a rotatable photosensitive member;

a charging portion configured to charge a surface of the photosensitive member;

an exposure portion configured to expose a charged surface of the photosensitive member based on image information to form an electrostatic image on the photosensitive member;

a developing portion configured to supply a toner to the electrostatic image on the photosensitive member to form a toner image on the photosensitive member;

a transfer portion configured to transfer the toner image on the photosensitive member to a transfer-receiving member at a transfer position;

a power supply configured to supply a transfer current to the transfer portion; and a control unit configured to control the power supply, wherein the image forming apparatus is able to form an image on a recording material of which a length is longer than a circumferential length of the photosensitive member with respect to a conveyance direction of the recording material, and wherein, in a case in which a second toner image to be transferred to a same surface of the recording material as a first toner image is to be transferred is formed on the photosensitive member after the first toner image is formed on the photosensitive member and the first toner image is formed on an area of the photosensitive member including at least a part of a position of the second toner image one cycle before with respect to a movement direction of the surface of the photosensitive member, the control unit changes a value of the transfer current at the time of transferring the first toner image to the transfer-receiving member between a first value and a second value of which an absolute value is greater than an absolute value of the first value, based on the image information regarding the second toner image.

2. The image forming apparatus according to claim 1, wherein, in a case in which the second toner image is a halftone image, the control unit sets the value of the transfer current at the time of transferring the first toner image to the transfer-receiving member to the second value.

3. The image forming apparatus according to claim 2, wherein the halftone image is an image having a coverage rate equal to or greater than 5% and equal to or less than 80%.

4. The image forming apparatus according to claim 2, wherein further in a case in which the first toner image is an image pattern satisfying a predetermined condition that is set in advance, the control unit sets the value of the transfer current at the time of transferring the first toner image to the transfer-receiving member to the second value.

5. The image forming apparatus according to claim 4, wherein the image pattern satisfying the predetermined condition includes at least one of a line image, a text image, and an isolated solid image.

6. The image forming apparatus according to claim 2, wherein further in a case in which the first toner image and the second toner image are formed on a position at which at least a part of the first toner image and at least a part of the second toner image overlap with each other with respect to a direction substantially perpendicular to the movement direction of the surface of the photosensitive member, the control unit sets the value of the transfer current at the time of transferring the first toner image to the transfer-receiving member to the second value.

7. The image forming apparatus according to claim 1, wherein, in a case in which an area of the photosensitive member on which the toner image to be transferred to one recording material over a plurality of cycles of the photosensitive member is formed is divided into a plurality of divided areas with respect to the movement direction of the surface of the photosensitive member, the control unit changes the value of the transfer current for each period during which each divided area passes through the transfer position.

8. The image forming apparatus according to claim 7, wherein a length of each of the plurality of divided areas with respect to the movement direction of the surface of the photosensitive member is equal to or less than the circumferential length of the photosensitive member.

9. The image forming apparatus according to claim 1, wherein a toner remaining on the surface of the photosensitive member after the toner image is transferred from the photosensitive member to the transfer-receiving member is collected by the developing portion.

* * * * *